US006046663A

United States Patent [19]

Kubomura et al.

[11] Patent Number: 6,046,663

[45] **Date of Patent: *Apr. 4, 2000**

[54] TRANSFORMER AND COIL BOBBIN THEREFOR

[75] Inventors: Tokutaro Kubomura, Kobe; Shiro Kokura, Hirakata, both of Japan

[73] Assignees: Kawatetsu Electric Engineering Co., Ltd., Hyogo-ken; Nishimoto Gosei Hanbai Co., Ltd., Osaka-fu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/453,094

[22] Filed: May 30, 1995

[30] Foreign Application Priority Data

May 30, 1994 [JP] Japan ..... 6-117023
Mar. 31, 1995 [JP] Japan ..... 7-099735

[51] Int. Cl.[7] ..... H01F 27/26; H01F 27/30

[52] U.S. Cl. ..... 336/198; 336/213

[58] Field of Search ..... 336/198, 196, 336/96, 98, 213, 223, 212, 208

[56] References Cited

U.S. PATENT DOCUMENTS 4,366,520 12/1982 Finke et al. ..... 336/212
5,506,559 4/1996 Yamaguchi ..... 336/212

FOREIGN PATENT DOCUMENTS 97599 1/1984 European Pat. Off. ..... 336/198
1424518 12/1964 France ..... 336/198
2311612 9/1972 Germany ..... 336/208
5-226168 9/1993 Japan .

*Primary Examiner*—Thomas J. Kozma
*Attorney, Agent, or Firm*—Sughrue, Mion, Zinn, Macpeak & Seas, PLLC

[57] ABSTRACT

A transformer comprising: a coil bobbin which includes a pair of core winding portions and a pair of coupling portions for coupling the core winding portions so as to space the core winding portions a predetermined distance from each other and is formed, on its whole outer periphery, with a groove; a winding which is obtained by winding a conductor around the groove of the coil bobbin a predetermined number of times; and a pair of wound cores each of which is obtained by winding an electromagnetic steel plate around each of the core winding portions of the coil bobbin a predetermined number of times; wherein an outer peripheral surface of each of opposite side walls of the groove at the core winding portions is curved so as to have an arcuate cross-sectional shape.

14 Claims, 29 Drawing Sheets

TRANSFORMER AND COIL BOBBIN THEREFOR

BACKGROUND OF THE INVENTION

The present invention generally relates to transformers such as a transformer for heavy current, a current transformer (CT), a potential transformer (PT) and a transformer for weak current and more particularly, to a transformer including a winding wound annularly a predetermined number of times and a pair of wound cores each obtained by winding an electromagnetic magnetic plate around the winding a predetermined number of times, and a coil bobbin for use in the transformer.

For example, Japanese Patent Laid-Open Publication No. 5-226168 (1993) filed by the assignee assigned by the present inventors discloses this kind of the transformer as shown in FIGS. 33 and 34. In this known transformer, an outer periphery 2*a* of a winding 2 obtained by annularly winding a conductor a predetermined number of times is coated by an insulating member (not shown) such as an insulating tape and an insulating sheet and each of a pair of wound cores 3 is obtained by winding an electromagnetic steel plate around the winding 2. In FIGS. 33 and 34, reference numeral 4 denotes a spacer and reference numeral 5 denotes a magnetic shunt core. In order to produce the winding 2, a conductor is wound around a split winding form (not shown) made of Bakelite or the like and then, the winding is coated by the insulating member by removing the winding form.

Meanwhile, the wound core 3 is formed by steps shown in FIGS. 35A to 35D. Initially, after a steel plate coil 7 obtained by winding a long belt-like electromagnetic steel plate 8 so as to have inside diameter coincident with outside diameter of the winding 2 has been annealed, the electromagnetic steel plate 8 disposed at an outermost portion of the steel plate coil 7 is passed between a pair of core winding portions 2*b* as shown in FIG. 35A. Then, as shown in FIG. 35B, a rear end portion 8*a* of the electromagnetic steel plate 8 is temporarily attached to an outer periphery of the steel plate coil 7 such that a large ring 9 having diameter larger than outside diameter of the steel plate coil 7 is formed by the electromagnetic steel plate 8. Furthermore, the steel plate coil 7 is rotated by driving rollers 11 and 12 such that the electromagnetic steel plate 8 is fed to the large ring 9 as shown by the arrow A. When rotation of the steel plate coil 7 is continued, whole of the electromagnetic steel plate 8 constituting the steel plate coil 7 is fed to the large ring 9 as shown in FIG. 35C. Since the electromagnetic steel plate 8 has elasticity, a force B for reducing diameter of the large ring 9 is applied to the large ring 9. When not only the roller 11 is drawn from the large ring 9 but the temporary attachment referred to above is cancelled, diameter of the large ring 9 is reduced as shown in FIG. 35D so as to tighten one of the core winding portions 2*b* such that the wound core 3 is formed.

However, the above mentioned known transformer has the following drawbacks. Namely, for winding a conductor 10 to the winding 2 in the transformer including the wound cores 3, if an alignment winding method of FIG. 36 in which the neighboring conductors 10 in each layer are held in close contact with each other and the conductors 10 in the neighboring layers deviate laterally from each other through a radius r of the conductor 10 such that gaps among the conductors 10 are minimized is employed and the outer periphery 2*a* of the winding 2 is brought into close contact with the wound cores 3, heat produced in the conductors 10 by electric current flowing therethrough, i.e., resistance loss is efficiently dissipated through the wound cores 3. Therefore, in order to reduce rise of temperature of the winding 2, it is preferable that the winding 2 is formed by the alignment winding method and the outer periphery 2*a* of the winding 2 is brought into close contact with the wound cores 3.

However, in case the winding 2 is produced by using the split winding form as described above, the winding 2 is readily deformed once the winding form has been removed. As a result, it is difficult to maintain the conductors 10 in a state of FIG. 36 in which the conductors 10 have been closely wound by the alignment winding method. Furthermore, since the winding 2 is readily deformed as described above, it is difficult to maintain a state in which cross-sectional shape of the winding 2 coincides with inside diameter of the wound cores 3 and thus, it is impossible to hold the outer periphery 2*a* of the winding 2 and inside diameter of the wound cores 3 in close contact with each other. Accordingly, in the known transformer referred to above, rise of temperature of the winding 2 caused by heat produced in the winding 2 cannot be prevented effectively and it is difficult to make the transformer compact.

Meanwhile, if insulating property of the winding 2 and the wound cores 3 deteriorates, performance of the transformer drops. In the construction in which the winding 2 is coated by the insulating member as described above, the insulating member may be damaged through contact between the outer periphery 2*a* of the winding 2 and the wound cores 3 in the step of FIG. 35C for feeding the electromagnetic steel plate 8 to the large ring 9 and through contact between an end of the electromagnetic steel plate 8 disposed at an innermost portion of the large ring 9 and the outer periphery 2*a* of the winding 2, thereby resulting in deterioration of insulating property of the winding 2 and the wound cores 3.

Furthermore, since it is difficult to make cross-sectional shape of the winding 2 coincident with inside diameter of the wound cores 3 as described above, such a case may happen in which inside diameter of the steel plate coil 7 is different from that of the wound cores 3 wound around the core winding portions 2*b*. In this case, residual strain is produced in the electromagnetic steel plate 7 constituting the wound core 3, thus resulting in deterioration of magnetic characteristics of the electromagnetic steel plate 8.

On the other hand, Japanese Utility Model Laid-Open Publication No. 54-177512 (1979) and Japanese Patent Laid-Open Publication No. 2-165610 (1990) disclose coil bobbins around which a conductor is wound and on which wound cores are formed. As shown in FIGS. 37 and 38, the former prior art document discloses a coil bobbin 19 constituted by outer and inner frames 17 and 18 formed, on the outer periphery, with grooves 17*a* and 18*a* for forming windings 16A and 16B by winding the conductor 10. Meanwhile, as shown in FIGS. 39 and 40, a transformer disclosed in the latter prior art document includes a first bobbin 23 constituted by primary and secondary frames 21 and 22 and a second bobbin 24 surrounding the first bobbin 23. The conductor 10 is wound a predetermined number of times around grooves 21*a* and 22*a* formed on the primary and secondary frames 21 and 22, respectively so as to form windings 25A and 25B. Meanwhile, a pair of wound cores 26 are provided on an outer periphery of the second bobbin 24.

In the above two coil bobbins, if outside diameter of the coil bobbin is made coincident with inside diameter of the wound cores when the winding is formed on the coil bobbin, the winding and the wound cores can be brought into close contact with each other. Meanwhile, if the coil bobbin is used, the wound core and the electromagnetic steel plate are held out of contact with each other when the wound core is wound around the winding, so that damage to the winding can be prevented. However, even if the coil bobbin is used, the following problem arise. Initially, in the known coil bobbins, since cross-sectional shape of the grooves 17*a*, 18*a*, 21*a* and 22*a* is semicircular, it is difficult to closely wind the conductor 10 by the alignment winding method. Hence, the windings 16A, 16B, 25A and 25B are set to a so-called disorderly winding state in which a number of gaps are formed among the conductors 10. Therefore, heat produced in the conductors 10 cannot be dissipated efficiently and thus, it is impossible to effectively reduce rise of temperature of the winding. Especially, in the outer frame 17 of FIG. 37 and the primary and secondary frames 21 and 22 of FIG. 40, since width W of their opening is smaller than width of the grooves 17*a*, 21*a* and 22*a*, it is extremely difficult to wind the conductor 10 by the alignment winding method.

Meanwhile, in the above known coil bobbins, since cross-sectional shape of a whole outer periphery of the coil bobbin is circular at its portion for winding the wound core therearound, friction between the coil bobbin and the electromagnetic steel plate 8 constituting the wound core is large when the wound core is formed. Thus, unless diameter of the large ring 9 shown in FIGS. 35B and 35C is formed large, it is difficult to wind the electromagnetic steel plate 8 around the coil bobbin smoothly. However, if diameter of the large ring 9 is increased, dimensional difference between the steel plate coil 7 and the large ring 9 increases, so that a portion of the electromagnetic steel plate 8, which is deformed beyond its elastic limit, is made larger and thus, magnetic characteristics of the wound core deteriorate.

SUMMARY OF THE INVENTION

Accordingly, an essential object of the present invention is to provide, with a view to eliminating the above mentioned drawbacks of conventional transformers, a transformer in which a winding can be wound positively and easily by an alignment winding method so as to reduce rise of temperature of the winding such that the transformer can be made compact and light.

Meanwhile, another object of the present invention is to prevent damage to the winding and production of strain of an electromagnetic steel plate caused at the time when a wound core is wound around the winding.

Furthermore, still another object of the present invention is to improve insulating property between the winding and the wound core and insulating property among conductors of the winding.

Moreover, a further object of the present invention is to improve working efficiency of operation of winding the wound core around the winding.

In order to accomplish these objects of the present invention, a transformer embodying the present invention comprises: a coil bobbin which includes a pair of core winding portions and a pair of coupling portions for coupling the core winding portions so as to space the core winding portions a predetermined distance from each other and is formed, on its whole outer periphery, with a groove; a winding which is obtained by winding a conductor around the groove of the bobbin a predetermined number of times; and a pair of wound cores each of which is obtained by winding an electromagnetic steel plate around each of the core winding portions of the coil bobbin a predetermined number of times; wherein an outer peripheral surface of each of opposite side walls of the groove at the core winding portions is curved so as to have an arcuate cross-sectional shape.

In accordance with the present invention, since the outer peripheral surface of each of the opposite side walls of the groove at the core winding portions is curved so as to have the arcuate cross-sectional shape, the wound cores are brought into close contact with the outer periphery of the coil bobbin and thus, heat produced by the winding is efficiently dissipated through the coil bobbin and the wound cores.

BRIEF DESCRIPTION OF THE DRAWINGS

These objects and features of the present invention will become apparent from the following description taken in conjunction with the preferred embodiment thereof with reference to the accompanying drawings, in which:

FIGS. 30A to 3OF are sectional views showing other examples of a double coil bobbin, respectively;

Before the description of the present invention proceeds, it is to be noted that like parts are designated by like reference numerals throughout several views of the accompanying drawings.

DETAILED DESCRIPTION OF THE INVENTION

Figure 1:
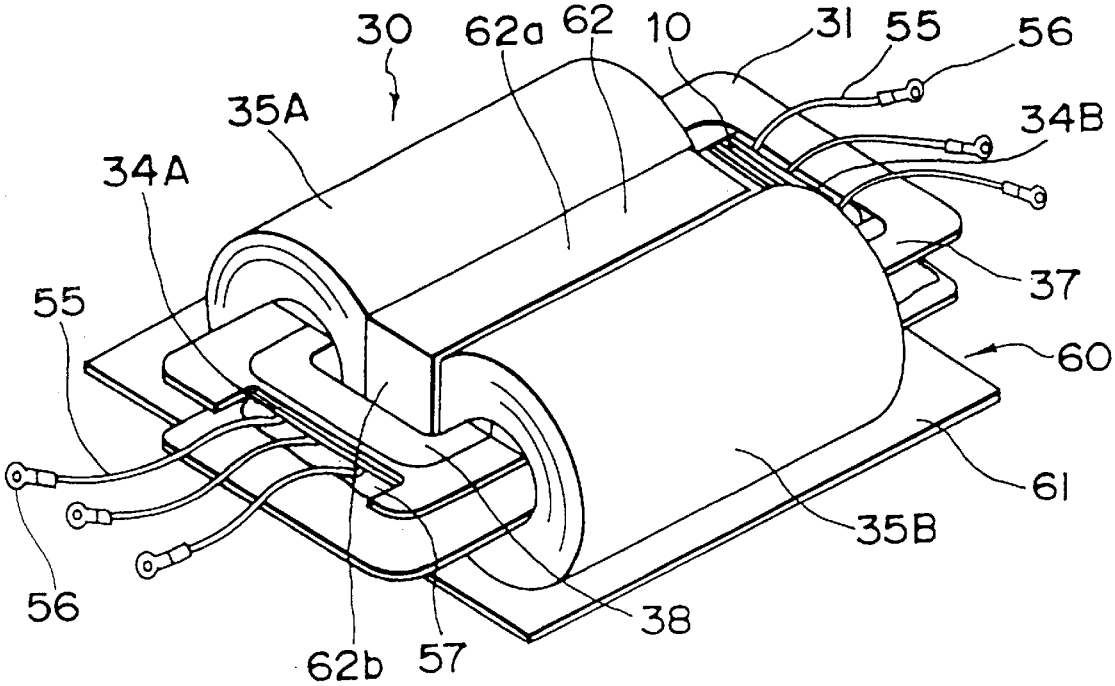
FIG. 1 is a perspective view of a transformer according to a first embodiment of the present invention.
Figure 2:
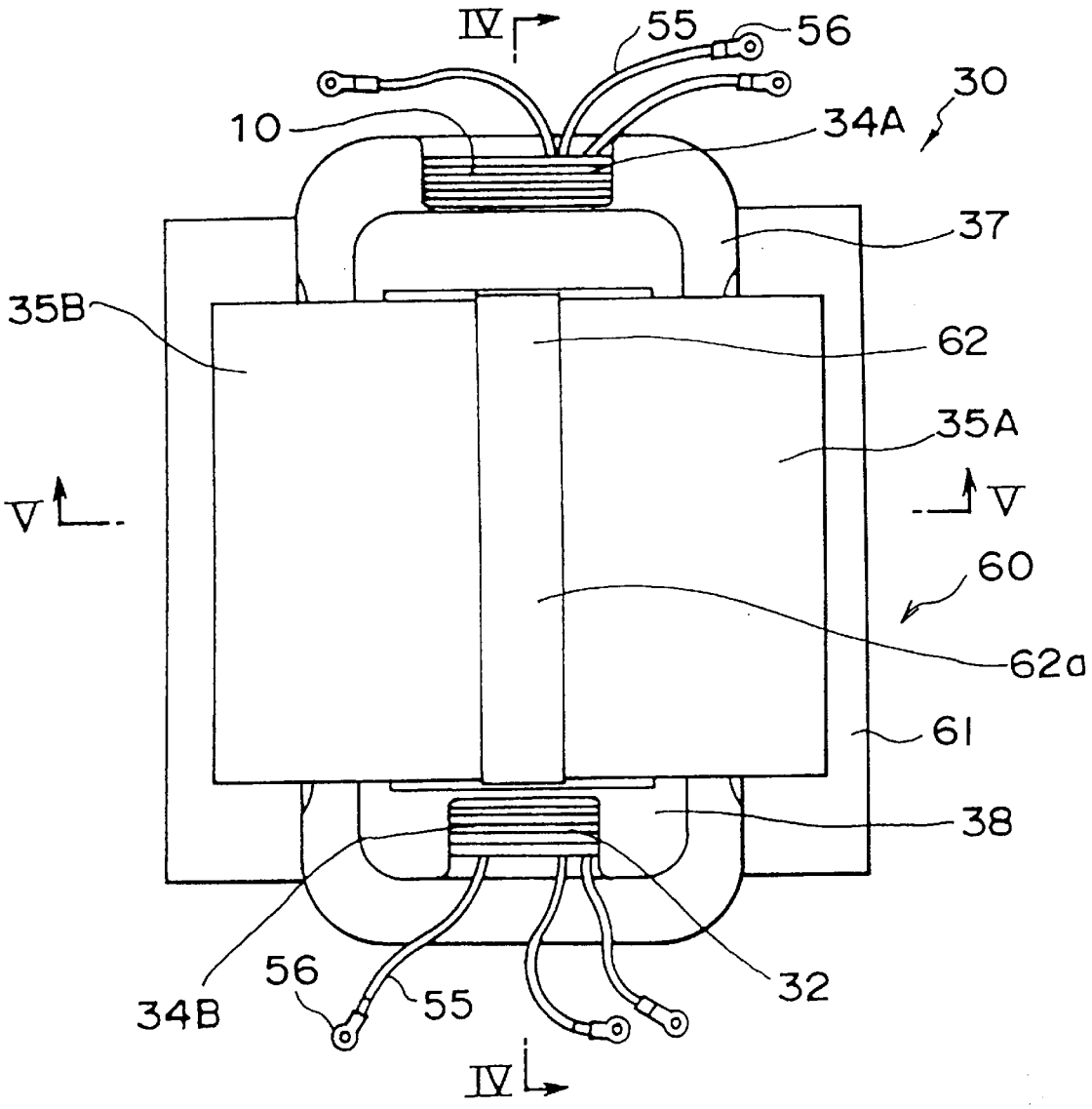
FIG. 2 is a top plan view of the transformer of FIG. 1.
Figure 3:
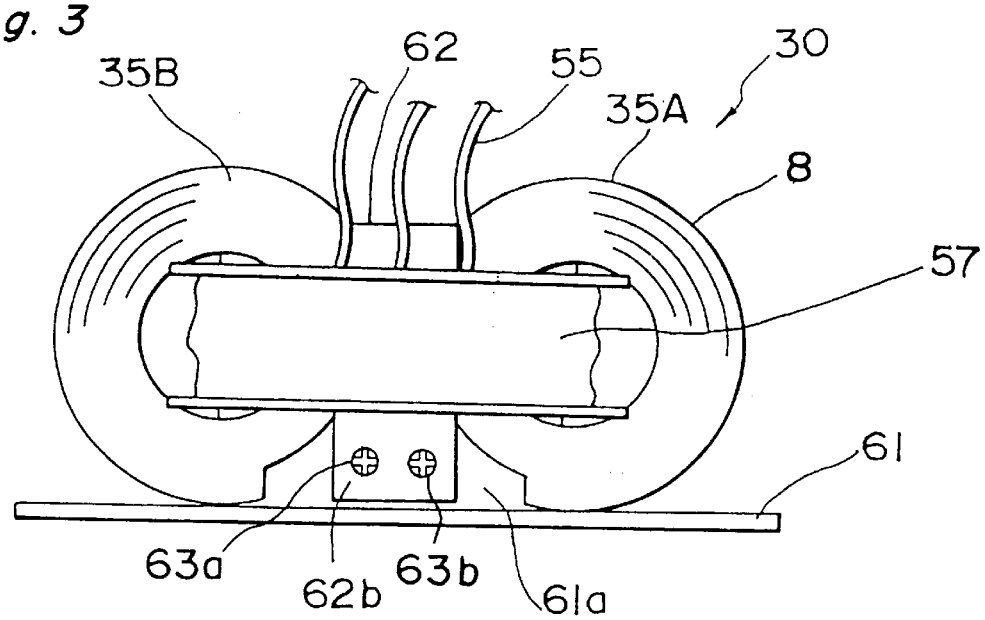
FIG. 3 is a left side elevational view of the transformer of FIG. 1.
Figure 4:
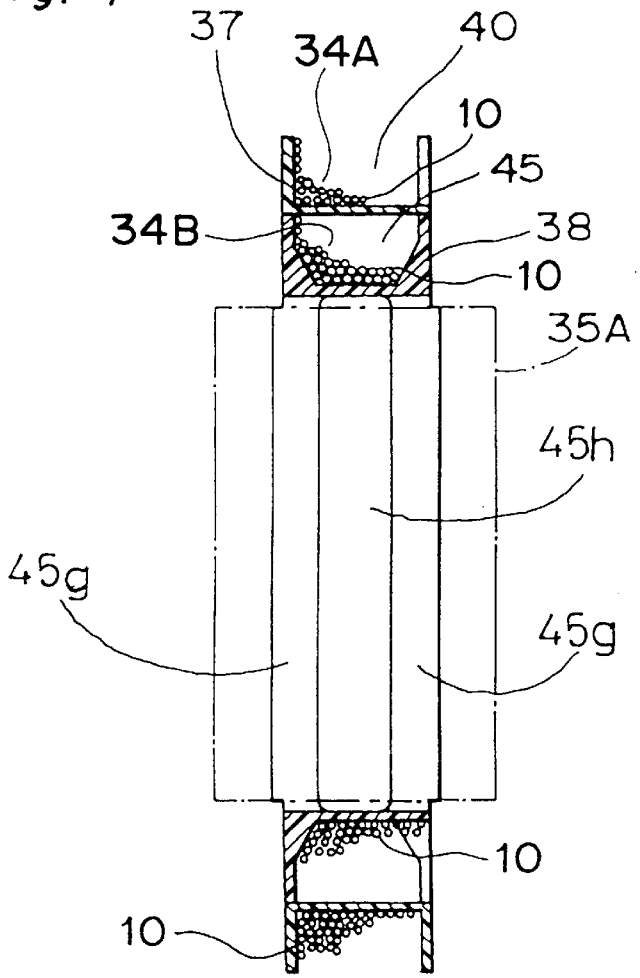
FIG. 4 is a sectional view taken along the line IV—IV in FIG. 2.

Referring now to the drawings, there is shown in FIGS. 1 to 5, a transformer 30 according to a first embodiment of the present invention. In the transformer 30, windings 34A and 34B are provided by winding a conductor 10 around a resinous coil bobbin 31 and a pair of wound cores 35A and 35B are wound around the coil bobbin 31.

Figure 6:
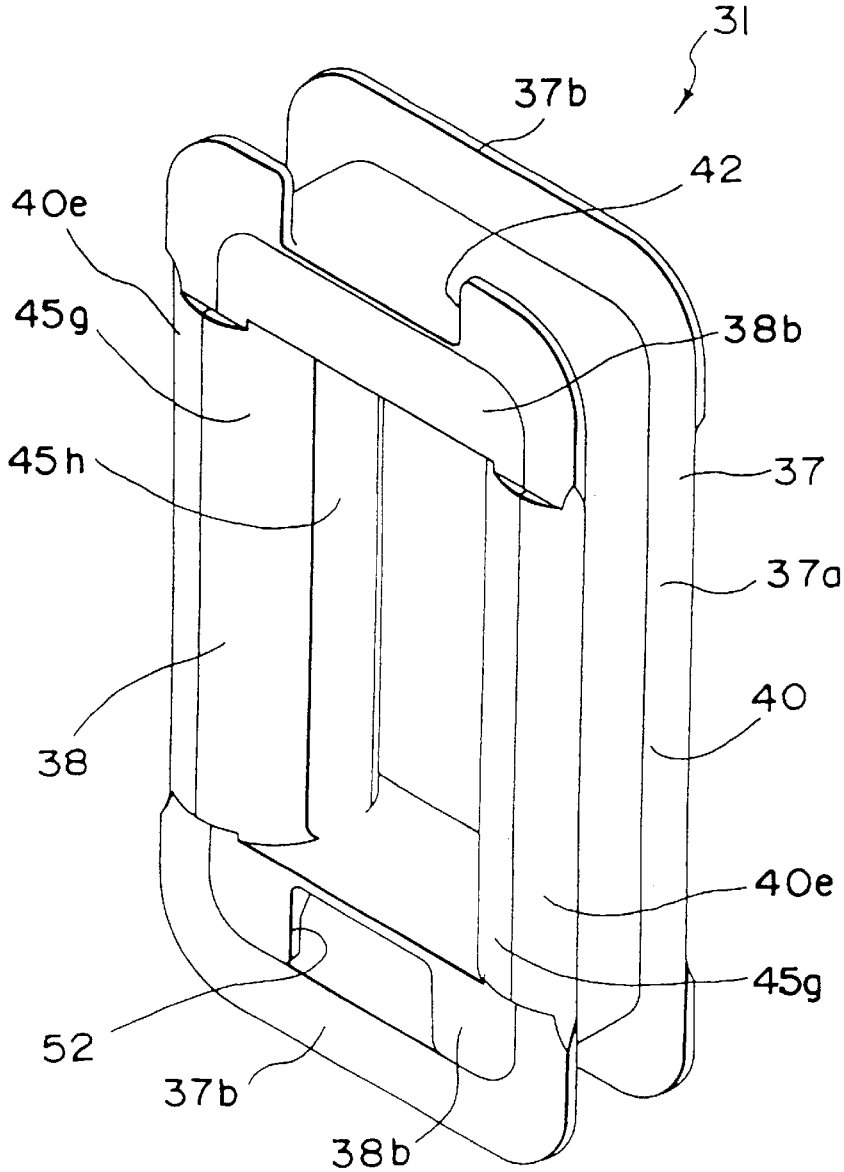
FIG. 6 is a perspective view of a coil bobbin employed in the transformer of FIG. 1.
Figure 7:
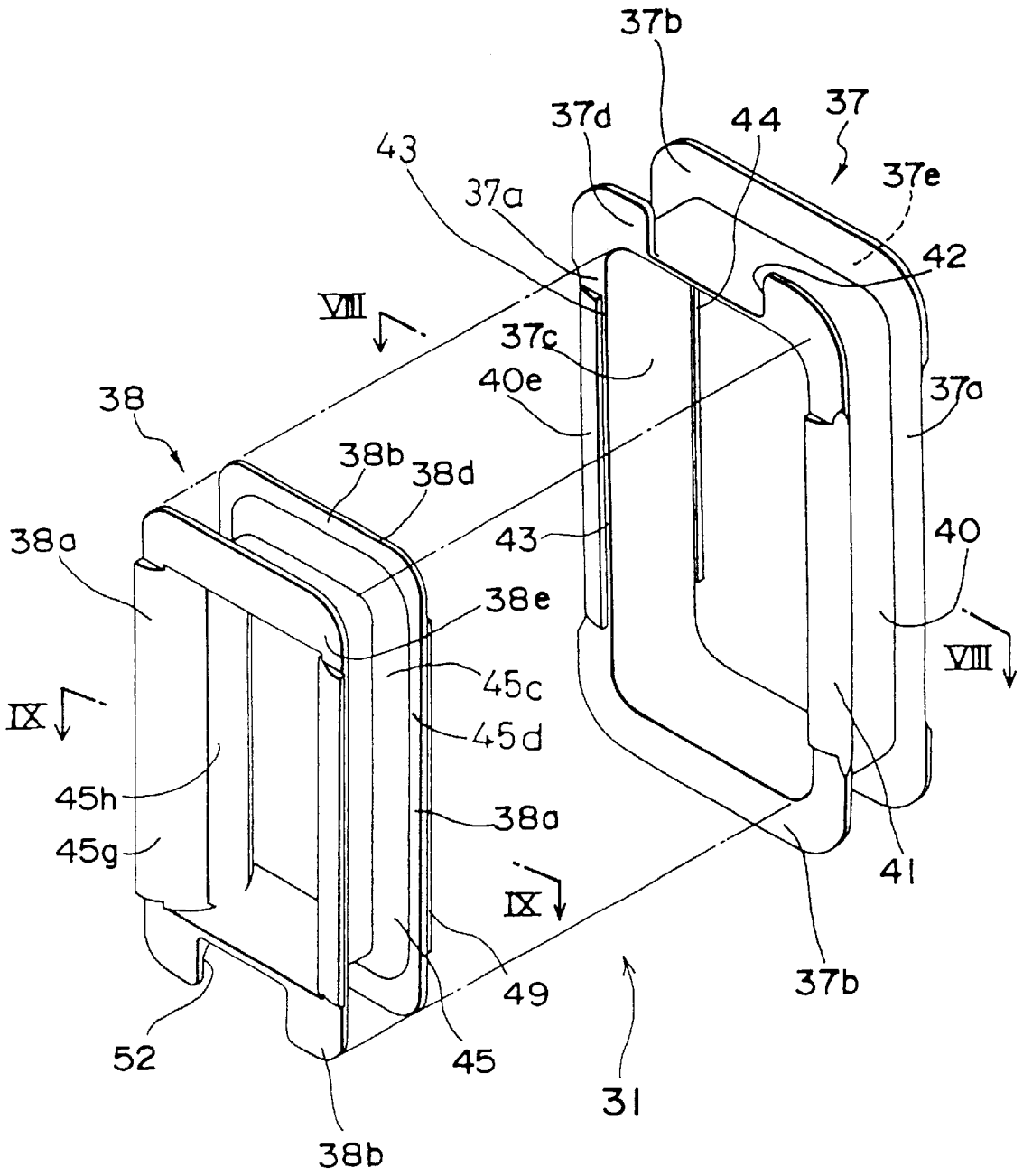
FIG. 7 is an exploded perspective view of the coil bobbin of FIG. 6.

As shown in FIGS. 6 and 7, the coil bobbin 31 includes a rectangular outer frame 37 and a rectangular inner frame 38 smaller than the outer frame 37 such that the inner frame 38 is integrally assembled with the outer frame 37. The outer frame 37 includes a pair of parallel core winding portions 37*a* and a pair of parallel coupling portions 37*b* for coupling the core winding portions 37*a* so as to space the core winding portions 37*a* a predetermined distance from each other. The core winding portions 37*a* and the coupling portions 37*b* are formed rectilinearly. A mounting opening 37*c* for receiving the inner frame 38 is formed at a central portion of the outer frame 37. Meanwhile, a U-shaped first groove 40 for forming the winding 34A is provided on a whole outer periphery of the outer frame 37.

Figure 8:
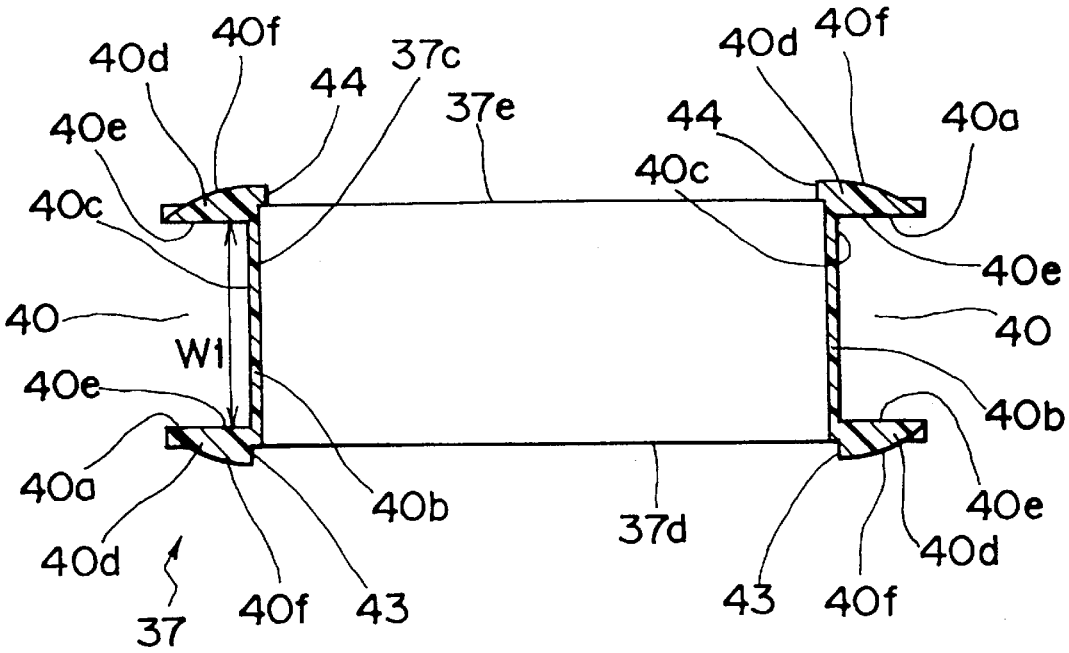
FIG. 8 is a sectional view taken along the line VIII—VIII in FIG. 7.

As shown in FIG. 8, the first groove 40 has a mouth 40*a* and is defined by a flat inner peripheral surface 40*c* of a bottom wall 40*b* and a pair of flat inner peripheral surfaces 40*e* of opposite side walls 40*d*. Since the inner peripheral surface 40*c* of the bottom wall 40*b* is connected with the inner peripheral surfaces 40*e* of the side walls 40*d* substantially orthogonally, the first groove 40 is of a rectangular cross-sectional shape having a width W1 constant from the bottom wall 40*b* to the mouth 40*a*. In the core winding portions 37*a*, cross section of each of a pair of outer peripheral surfaces 40*f* of the side walls 40*d* is curved arcuately and radius of curvature of these curved outer peripheral surfaces 40*f* is so set as to be equal to inside diameter of the wound cores 35A and 35B.

The outer frame 37 has opposite faces 37*d* and 37*e*. At the side of one face 37*d* of the outer frame 37, a recess 43 having an L-shaped cross section and engageable with the inner frame 38 is formed at one edge of each of the core winding portions 37*a* adjacent to the mounting opening 37*c* as shown in FIGS. 7 and 8. Meanwhile, at the side of the other face 37*e* of the outer frame 37, a boss 44 engageable with the inner frame 38 is formed at one edge of each of the core winding portions 37*a* adjacent to the mounting opening 37*c* as shown in FIG. 8. Furthermore, a wire lead-out portion 42 is provided at one of the opposite coupling portions 37*b* by notching one of the opposite side walls 40*d*.

On the other hand, the inner frame 38 includes a pair of parallel core winding portions 38*a* and a pair of parallel coupling portions 38*b* for coupling the core winding portions 38*a* so as to space the core winding portions 38*a* a predetermined distance from each other. The core winding portions 38*a* and the coupling portions 38*b* are formed rectilinearly. Meanwhile, a U-shaped second groove 45 for forming the winding 34B is provided on a whole outer periphery of the inner frame 38.

Figure 9:
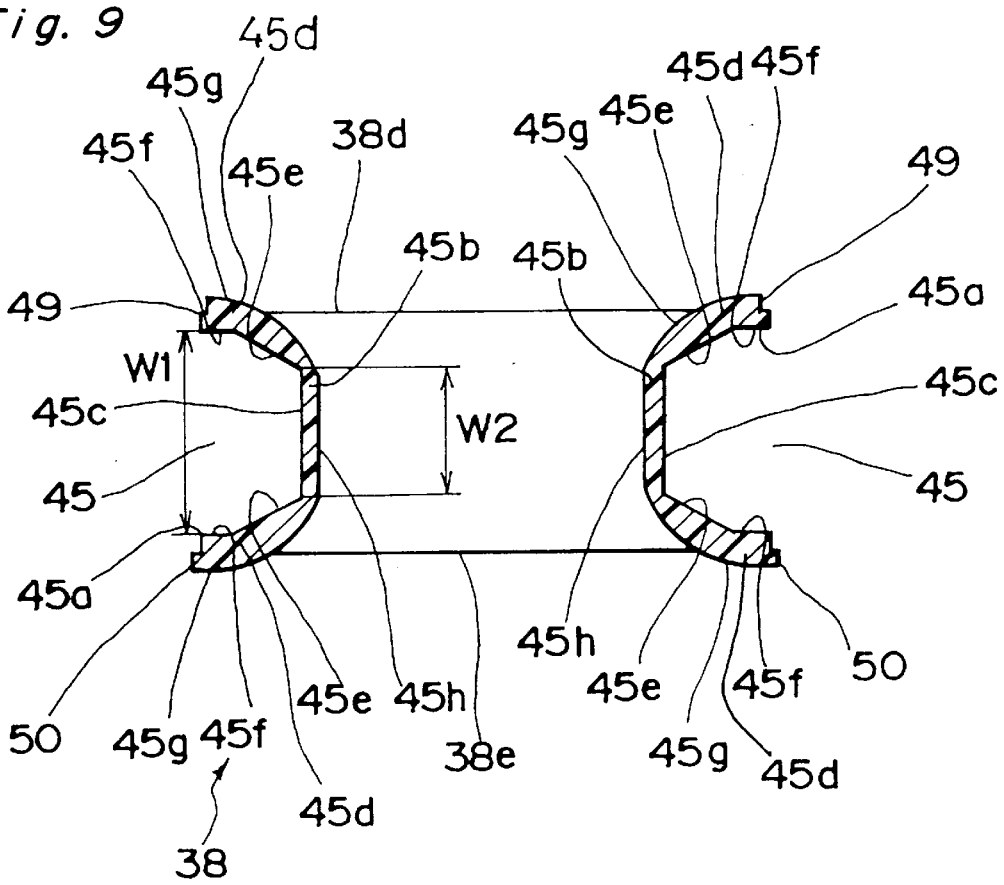
FIG. 9 is a sectional view taken along the line IX—IX in FIG. 7.

As shown in FIG. 9, the second groove 45 has a mouth 45*a* and is defined by a flat inner peripheral surface 45*c* of a bottom wall 45*b*, a pair of first inner peripheral surfaces 45*e* of opposite side walls 45*d* and a pair of second inner peripheral surfaces 45*f* of the side walls 45*d*. The first inner peripheral surface 45*e* of the side wall 45*d* is connected with the inner peripheral surface 45*c* of the bottom wall 45*b* at an angle of about 120°, while the second inner peripheral surface 45*f* of the side wall 45*d* extends at right angles to the inner peripheral surface 45*c* of the bottom wall 45*b* and therefore, is connected with the first inner peripheral surface 45*e* at an angle of about 120°. Accordingly, the second groove 45 has an open hexagonal cross-sectional shape of a channel steel. A distance between the opposed second inner peripheral surfaces 45*f*, i.e., a width of the mouth 45*a* of the second groove 45 is so set as to be equal to the width W1 of the first groove 40 of the outer frame 37 and is larger than a width W2 of the second groove 45 on the inner peripheral surface 45*c* of the bottom wall 45*b*.

In the core winding portions 38*a*, cross section of each of opposite outer peripheral surfaces 45*g* of the side walls 45*d* is curved arcuately and radius of curvature of these curved outer peripheral surfaces 45*g* is so set as to be equal to inside diameter of the wound cores 35A and 35B. Furthermore, in the core winding portions 38*a*, an outer peripheral surface 45*h* of the bottom wall 45*b* is formed flat.

The inner frame 38 has opposite faces 38*d* and 38*e*. At the side of one face 38*d* of the inner frame 38, a recess 49 having an L-shaped cross section is formed at an outer edge of each of the core winding portions 38*a*. Meanwhile, at the side of the other face 38*e* of the inner frame 38, a boss 50 is formed at an outer edge of each of the core winding portions 38*a*. In the same manner as the outer frame 37, a wire lead-out portion 52 is provided at one of the opposite coupling portions 38*b* of the inner frame 38 by notching one of the side walls 45*d*.

When the inner frame 38 is inserted into the mounting opening 37*c* of the outer frame 37 by causing one face 38*d* of the inner frame 38 and one face 37*d* of the outer frame 37 to confront each other as shown in FIG. 7, not only the bosses 50 of the inner frame 38 are, respectively, brought into engagement with the recesses 43 of the outer frame 37 but the bosses 44 of the outer frame 37 are, respectively, brought into engagement with the recesses 49 of the inner frame 38. As a result, the inner frame 38 is integrally assembled with the outer frame 37.

Figure 5:
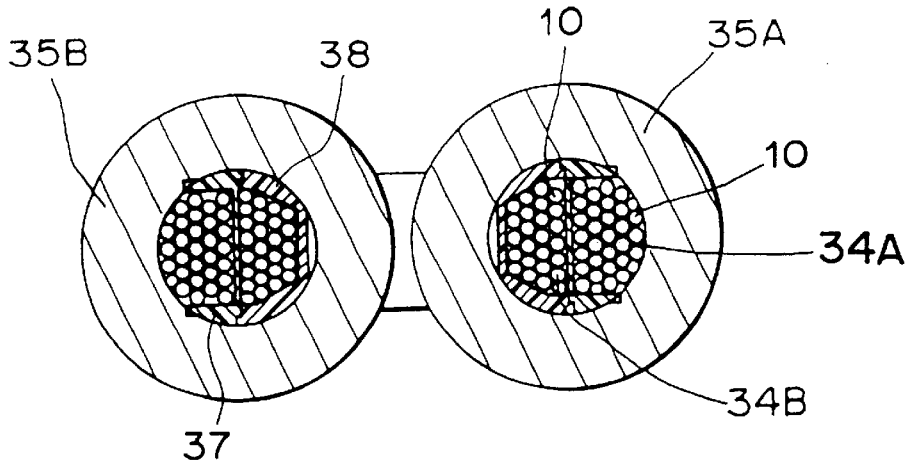
FIG. 5 is a sectional view taken along the line V—V in FIG. 2.

In a state in which the inner frame 38 has been assembled with the outer frame 37 as shown in FIG. 6, the opposite outer peripheral surfaces 40*f* of the first groove 40 of the outer frame 37 and the opposite outer peripheral surfaces 45*g* of the second groove 45 of the inner frame 38 are made flush with each other so as to form continuous curved surfaces having a radius of curvature equal to a predetermined inside diameter of the wound cores 35A and 35B as shown in FIG. 5. Meanwhile, in the state in which the inner frame 38 has been assembled with the outer frame 37, since the width W1 of the first groove 40 of the outer frame 37 is equal to the width W1 of the mouth 45*a* of the second groove 45 as described above, each of the first groove 40 of the outer frame 37 and the second groove 45 of the inner frame 38 exhibits a cross-sectional shape of a channel steel as shown in FIG. 5.

Figure 10:
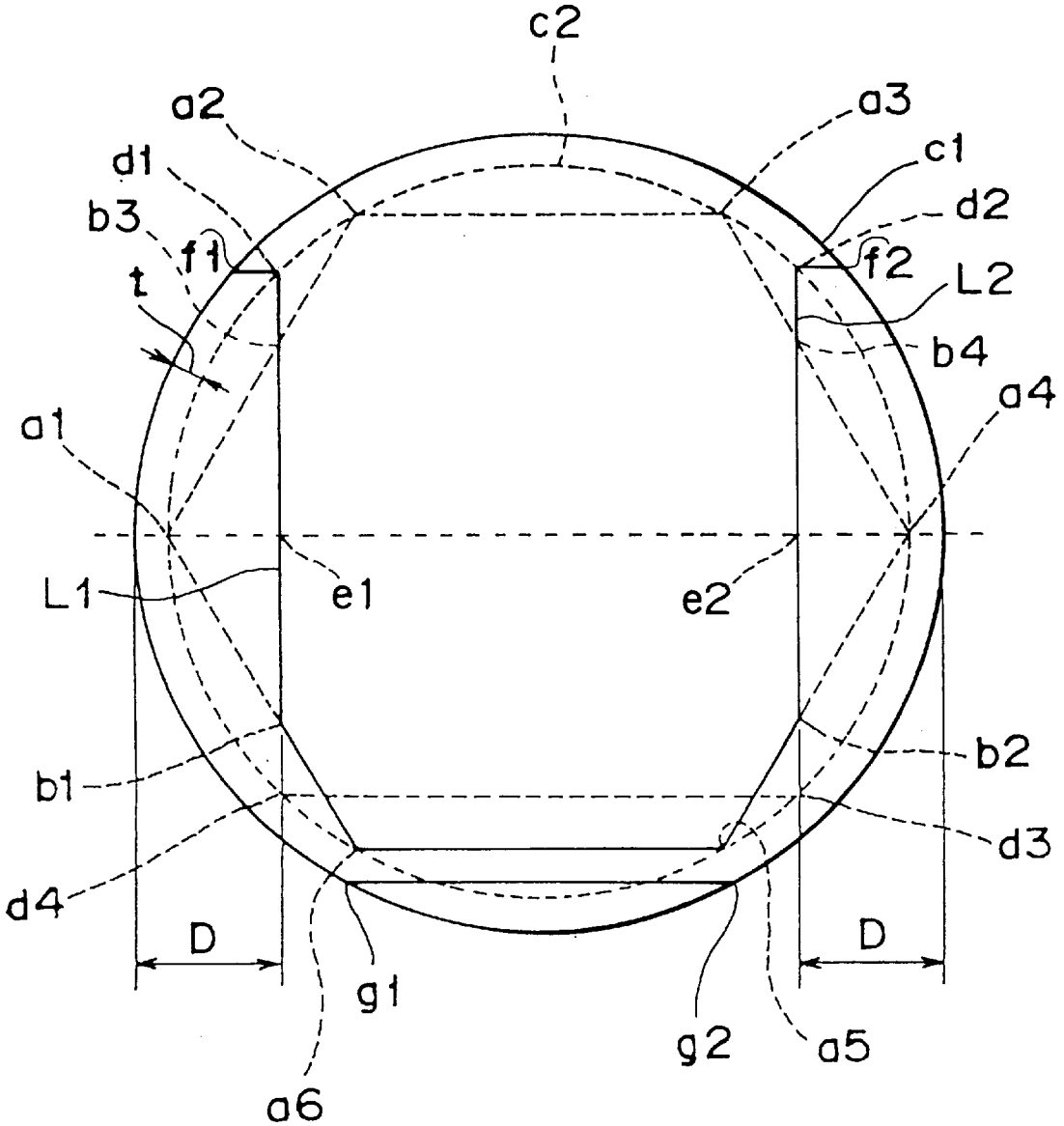
FIG. 10 is a schematic view explanatory of setting of cross-sectional shape of a groove and a core winding portion of the coil bobbin of FIG. 6.

Geometry of the core winding portions 37*a* and 38*a* and the first and second grooves 40 and 45 of the outer and inner frames 37 and 38 is set as follows. In FIG. 10, a circle c1 has a diameter equal to the predetermined inside diameter of the wound cores 35A and 35B, while a circle c2 has a diameter smaller than that of the circle c1 by a minimum thickness t for securing strength and electrical insulation. A regular hexagon a1 to a6 is so set as to be inscribed to this circle c2. Then, parallel straight lines L1 and L2 are so set as to deviate from opposite ends of the circle c1 inwardly through a distance equal to a thickness D of the side walls 40*d* and 45*d* of the first and second grooves 40 and 45, which thickness D is determined in view of strength of the side walls 40*d* and 45*d*. Reference numerals b1 and b3 denote points of intersection between the straight line L1 and the regular hexagon a1 to a6, while reference numerals b2 and b4 denote points of intersection between the straight line L2 and the regular hexagon a1 to a6. Reference numerals d1 and d4 denote points of intersection between the straight line L1 and the circle c2, while reference numerals d2 and d3 denote points of intersection between the straight line L2 and the circle c2. Furthermore, reference numerals e1 and e2 denote points of intersection between a straight line connecting the vertexes a1 and a4 and the straight lines L1 and L2.

At this time, a hexagon d1, b1, a6, a5, b2 and d2 is defined by the first and second grooves 40 and 45. A rectangle d1, e1, e2 and d2 corresponds to a cross-sectional shape of the first groove 40. In this hexagon, a rectangle d1, e1, e2 and d2 corresponds to a cross-sectional shape of the first groove 40, while a hexagon e1, b1, a6, a5, b2 and e2 corresponds to a cross-sectional shape of the second groove 45.

In the first embodiment, since the cross-sectional shapes of the first and second grooves 40 and 45 are set as described above, not only the first and second grooves 40 and 45 occupy large areas inside the wound cores 35A and 35B but strength and electrical insulation required of the coil bobbin 31 are secured.

Meanwhile, in FIG. 10, supposing that reference numerals f1 and f2 denote points of intersection between the circle c1 and straight lines extending outwardly from the points d1 and c1 in parallel with the side a2–a3, respectively and reference numerals g1 and g2 denote points of intersection between the circle c1 and a straight line spaced downwardly a proper distance from the side a5–a6 and extending in parallel with the side a5–a6, respectively, external shape of the core winding portions 37*a* and 38*a* is so set as to correspond to a shape d1, f1, g1, g2, f2 and d2. Since the diameter of the circle c1 is equal to the inside diameter of the wound cores 35A and 35B as described above, inner peripheries of the wound cores 35A and 35B and outer peripheries of the core winding portions 37*a* and 38*a* can be brought into close contact with each other by setting external shape of the core winding portions 37*a* and 38*b* as referred to above.

The winding 34A and 34B are formed by winding the conductors 10 around the first and second grooves 40 and 45 of the outer and inner frames 37 and 38 of the coil bobbin 31. Lead-out wires 55 are connected with the windings 34A and 34B, respectively and a pressure welding terminal 56 is provided at a distal end of each of the lead-out wires 55. Outer peripheries of the windings 34A and 34B provided in the first and second grooves 40 and 45 are, respectively, coated by insulating members 57 as shown in FIG. 1. Meanwhile, electromagnetic steel plates 8 are wound around the core winding portions 37*a* and 38*a* so as to form the wound cores 35A and 35B, respectively.

The coil bobbin 31, the windings 34A and 34B and the wound cores 35A and 35B are secured to a frame 60. This frame 60 includes a base plate 61 having a pair of raised portions 61*a* and a U-shaped mounting member 62. This mounting member 62 has an elongated contact portion 62*a* brought into contact with the outer peripheries of the windings 34A and 34B and a pair of mounting portions 62*b* provided at opposite ends of the contact portion 62*a*. The coil bobbin 31, the windings 34A and 34B and the wound cores 35A and 35B are fixed to the base plate 61 by attaching the mounting portions 62*b* to the raised portions 61*a* with screws 63*a* and 63*b*. Meanwhile, the frame 60 is not restricted to this construction. For example, a terminal portion for securing the pressure welding terminal 56 thereto may also be provided on the frame 60.

Figure 36:
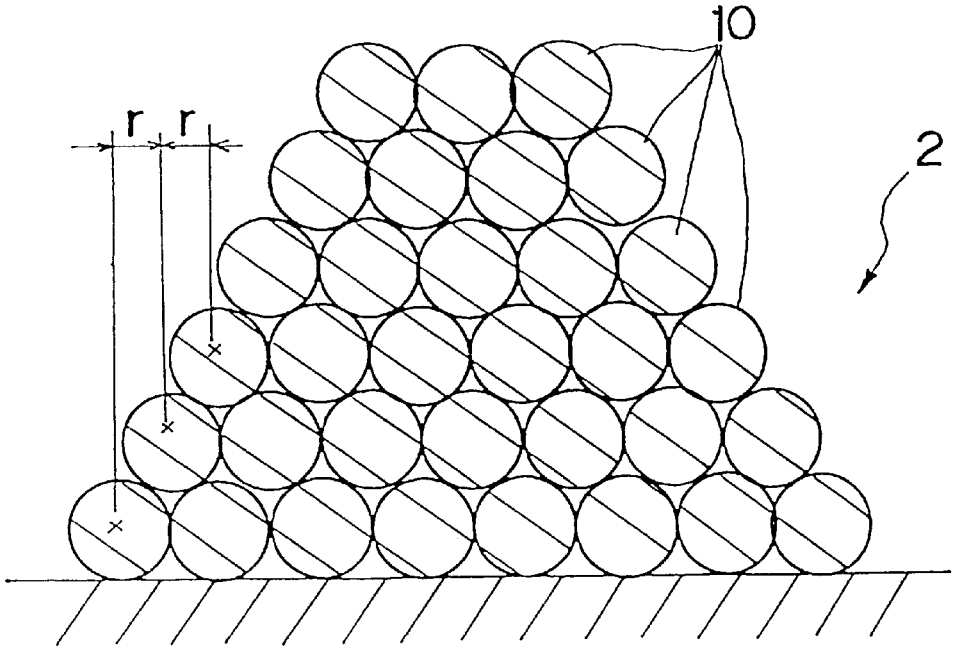
Fig. 36 PRIOR ART
FIG. 36 is a sectional view showing alignment winding of conductors of the prior art transformer of FIG. 33.
Figure 37:
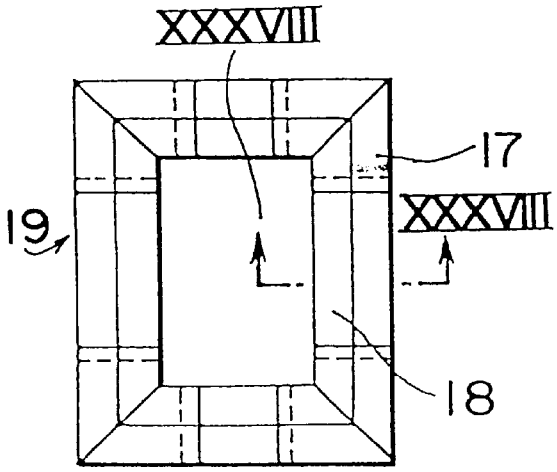
Fig. 37 PRIOR ART
FIG. 37 is a front elevational view of a prior art coil bobbin.
Figure 38:
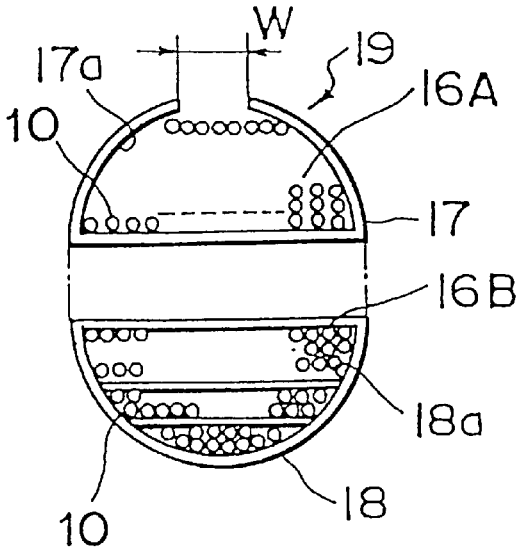
Fig. 38 PRIOR ART
FIG. 38 is a sectional view taken along the line XXXVIII—XXXVIII in FIG. 37.
Figure 39:
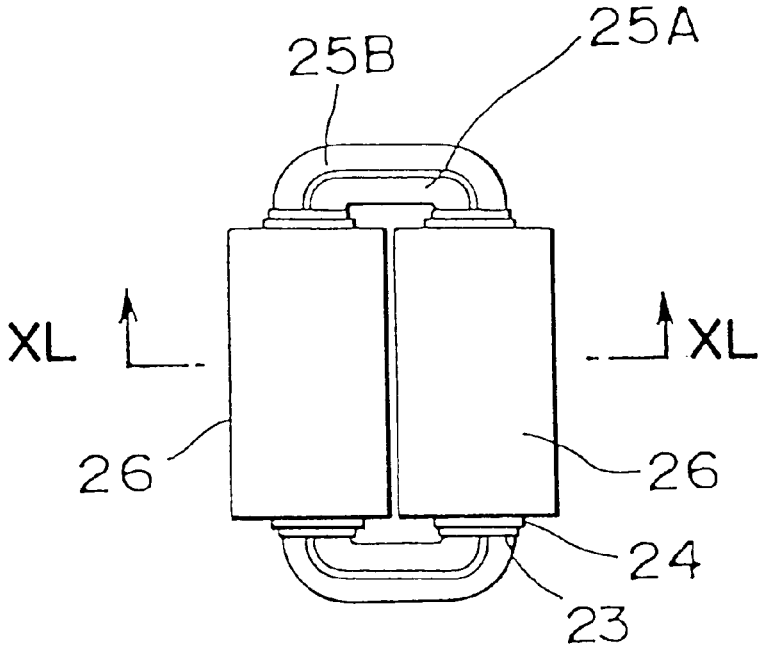
Fig. 39 PRIOR ART
FIG. 39 is a schematic view of another prior art transformer.
Figure 40:
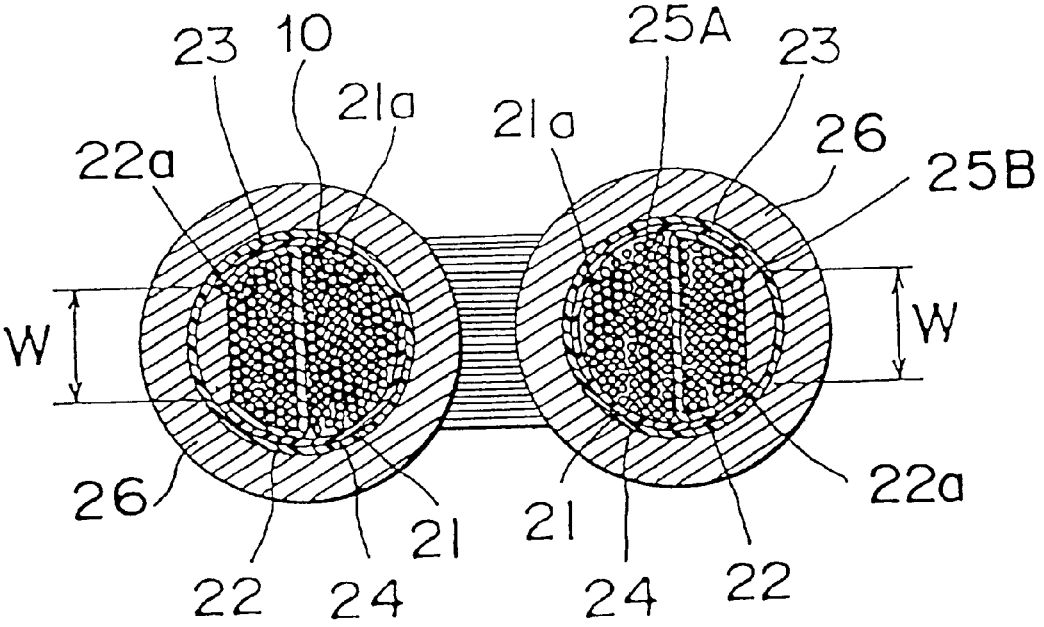
Fig. 40 PRIOR ART
FIG. 40 is a sectional view taken along the line XL—XL in FIG. 39.

In the transformer 30 of the first embodiment, since the first groove 40 of the outer frame 37 of the coil bobbin 31 has a rectangular cross-sectional shape and the second groove 45 of the inner frame 38 of the coil bobbin 31 has a cross-sectional shape of a channel steel, the conductors 10 constituting the windings 34A and 34B can be wound closely by an alignment winding method of FIG. 36. Meanwhile, in the first embodiment, since the width W1 of the first and second grooves 40 and 45 at the mouths 40*a* and 45*a* is not less than the width W1 of the first groove 40 at the bottom wall 40*b* and the width W2 of the second groove 45 at the bottom wall 45*b*, the conductors 10 constituting the windings 34A and 34B can be wound easily by the alignment winding method. Furthermore, in the first embodiment, since the outer peripheral surfaces 40*f* and 45*g* of the side walls 40*d* and 45*d* of the first and second grooves 40 and 45 of the core winding portions 37*a* and 38*a* is curved so as to have the radius of curvature equal to the inside diameter of the wound cores 35A and 35B, the wound cores 35A and 35B are brought into close contact with the coil bobbin 31.

Therefore, heat produced by the conductors 10 constituting the windings 34A and 34B is efficiently dissipated through the coil bobbin 31 and the wound cores 35A and 35B, thereby resulting in excellent heat dissipation.

In addition, in the first embodiment, since the coil bobbin 31 is constituted by the outer and inner frames 37 and 38 provided separately and the windings 34A and 34B are, respectively, wound around the outer and inner frames 37 and 38, electrical insulation between the windings 34A and 34B is excellent.

Then, production method of the transformer 30 is described. Initially, the conductors 10 are, respectively, wound predetermined numbers of times around the first and second grooves 40 and 45 of the outer and inner frames 37 and 38 so as to form the windings 34A and 34B. As described above, since the core winding portions 37*a* and 38*a* and the coupling portions 37*b* and 38*b* of the outer and inner frames 37 and 38 are formed rectilinearly and the first and second grooves 40 and 45 are formed so as to have the above mentioned cross-sectional shapes, the conductors 10 can be easily wound around the first and second grooves 40 and 45 by the alignment winding method. Subsequently, after the outer peripheries of the windings 34A and 34B have been coated by the insulating members 57, respectively, the inner frame 38 is assembled with the outer frame 37.

Thereafter, by using a prior art method shown in FIGS. 35A to 35D, the wound cores 35A and 35B are formed by winding the electromagnetic steel plate 8 around the core winding portions 37*a* and 38*a* of the coil bobbin 31. In the core winding portions 38*a* of the inner frame 38, since the outer peripheral surface 45*h* of the bottom wall 45*b* of the second groove 45 is formed flat as described above, friction between the electromagnetic steel plate 8 and the coil bobbin 31 is reduced. Therefore, in the first embodiment, since diameter of a large ring 9 in FIG. 35B can made small, the electromagnetic steel plate 8 of a steel plate coil 7 can be wound around the core winding portions 37*a* and 38*a* without distorting the electromagnetic steel plate 8 greatly and thus, the wound cores 35A and 35B having excellent magnetic characteristics can be formed.

Meanwhile, since the windings 34A and 34B are formed in the first and second grooves 40 and 45 of the coil bobbin 31, respectively as described above, the windings 34A and 34B are not brought into contact with the steel plate coil 7 at the time of winding of the wound cores 35A and 35B, so that there is no damage to the insulating member 57 surrounding the outer peripheries of the windings 34A and 34B and thus, electrical insulation between the windings 34A and 34B and the wound cores 35A and 35B does not deteriorate.

Furthermore, in the core winding portions 37*a* and 38*a* of the outer and inner frames 37 and 38 of the coil bobbin 31, since the outer peripheral surfaces 40*f* and 45*g* of the side walls 40*d* and 45*d* of the first and second grooves 40 and 45 are curved so as to have the radius of curvature equal to the inside diameter of the wound cores 35A and 35B as described above, residual strain is not produced in the electromagnetic steel plate 8 wound, as the wound cores 35A and 35B, around the coil bobbin 31 and thus, the electromagnetic steel plate 8 constituting the wound cores 35A and 35B has excellent magnetic characteristics. After the wound cores 35A and 35B have been formed, the windings 34A and 34B and the wound cores 35A and 35B are varnished and then, are mounted on the frame 60.

Figure 11:
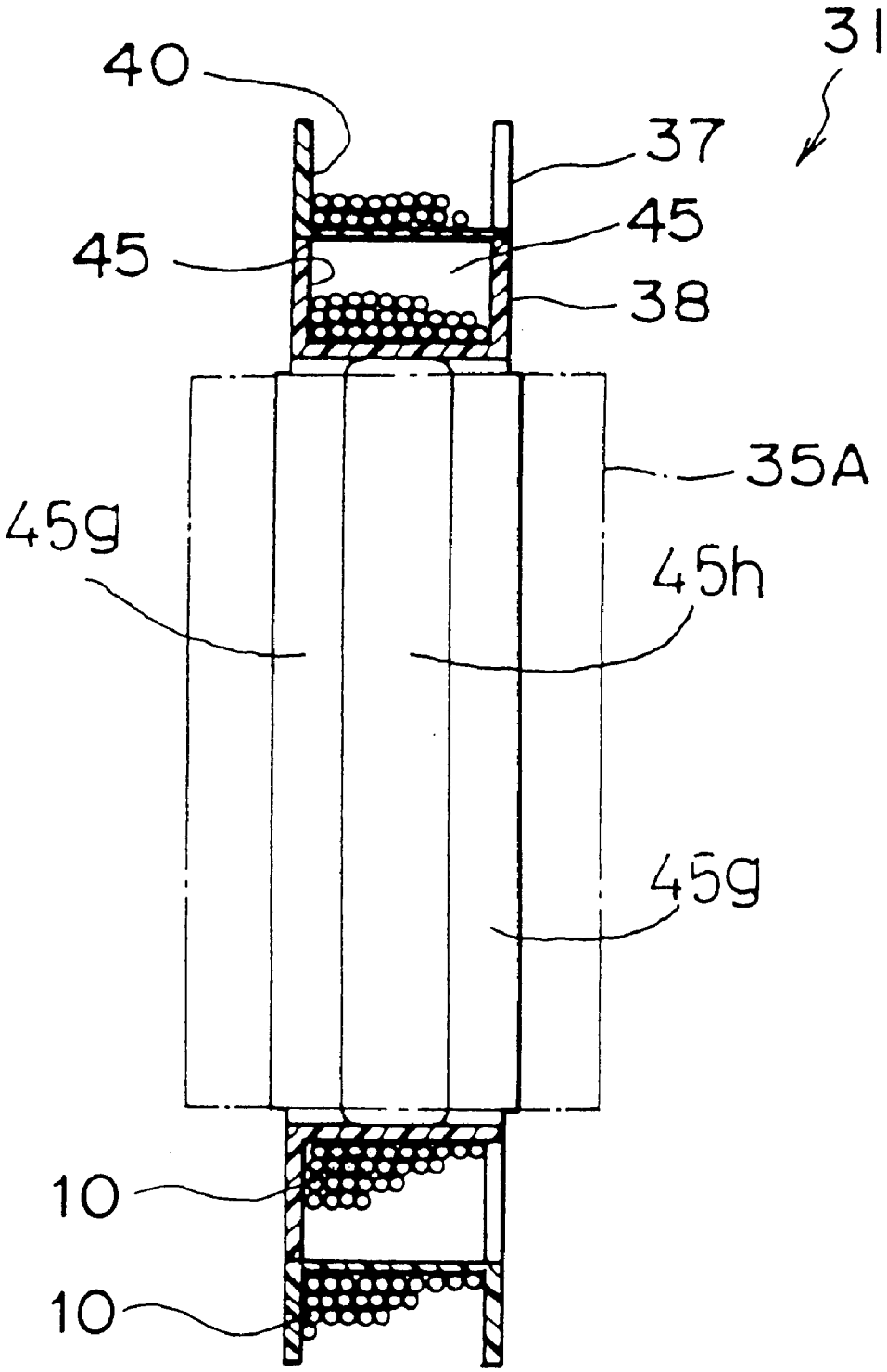
FIG. 11 is a sectional view of a coil bobbin employed in a transformer according to a second embodiment of the present invention.

FIG. 11 shows a coil bobbin 31 employed in a transformer according to a second embodiment of the present invention. In this coil bobbin 31, the second groove 45 of the inner frame 38 has a rectangular cross-sectional shape. Thus, when the outer and inner frames 37 and 38 have been assembled with each other, the first and second grooves 40 and 45 exhibit a rectangular cross-sectional shape. Other constructions of the second embodiment are identical with those of the first embodiment referred to above.

In the second embodiment, cross-sectional shape of the core winding portions 37*a* and 38*a* of the outer and inner frames 37 and 38 and shape of the first and second grooves 40 and 45 of the outer and inner frames 37 and 38 are set as follows. Namely, in FIG. 10, cross-sectional shape of the first and second grooves 40 and 45 is set to a rectangle d1, d2, d3 and d4.

Also in the second embodiment, shape of the first and second grooves 40 and 45 is set such that the conductors 10 can be closely wound by the alignment winding method in as wide an area as possible in the wound cores 35A and 35B. Meanwhile, since the outer peripheral surfaces 40*f* and 45*g* of the side walls 40*d* and 45*d* of the first and second grooves 40 and 45 of the core winding portions 37*a* and 38*a* are curved so as to have a radius of curvature equal to an inside diameter of the wound cores 35A and 35B, outer periphery of the coil bobbin 31 and inner periphery of each of the wound cores 35A and 35B are brought into close contact with each other. Therefore, heat produced by the conductors 10 is efficiently dissipated through the coil bobbin 31 and the wound cores 35A and 35B and thus, excellent performance can be obtained even when the coil bobbin 31 is compact. Meanwhile, since distortion is not produced in the electromagnetic steel plate 8 wound around the coil bobbin 31, the wound cores 35A and 35B have excellent magnetic characteristics.

Furthermore, in the second embodiment, since the outer peripheral surface 45*h* of the bottom wall 45*b* of the second groove 45 is formed flat at the core winding portion 38*a* of the inner frame 38, friction between the electromagnetic steel plate 8 and the coil bobbin 31 is reduced. As a result, deformation of the electromagnetic steel plate 8 at the time of formation of the wound cores 35A and 35B is reduced and thus, the wound cores 35A and 35B having excellent magnetic characteristics can be obtained.

Moreover, in the second embodiment, such a phenomenon can be prevented that insulating property between the windings 34A and 34B and the wound cores 35A and 35B deteriorate due to contact of the windings 34A and 34B with the steel plate coil 7 at the time of formation of the wound cores 35A and 35B.

Figure 12:
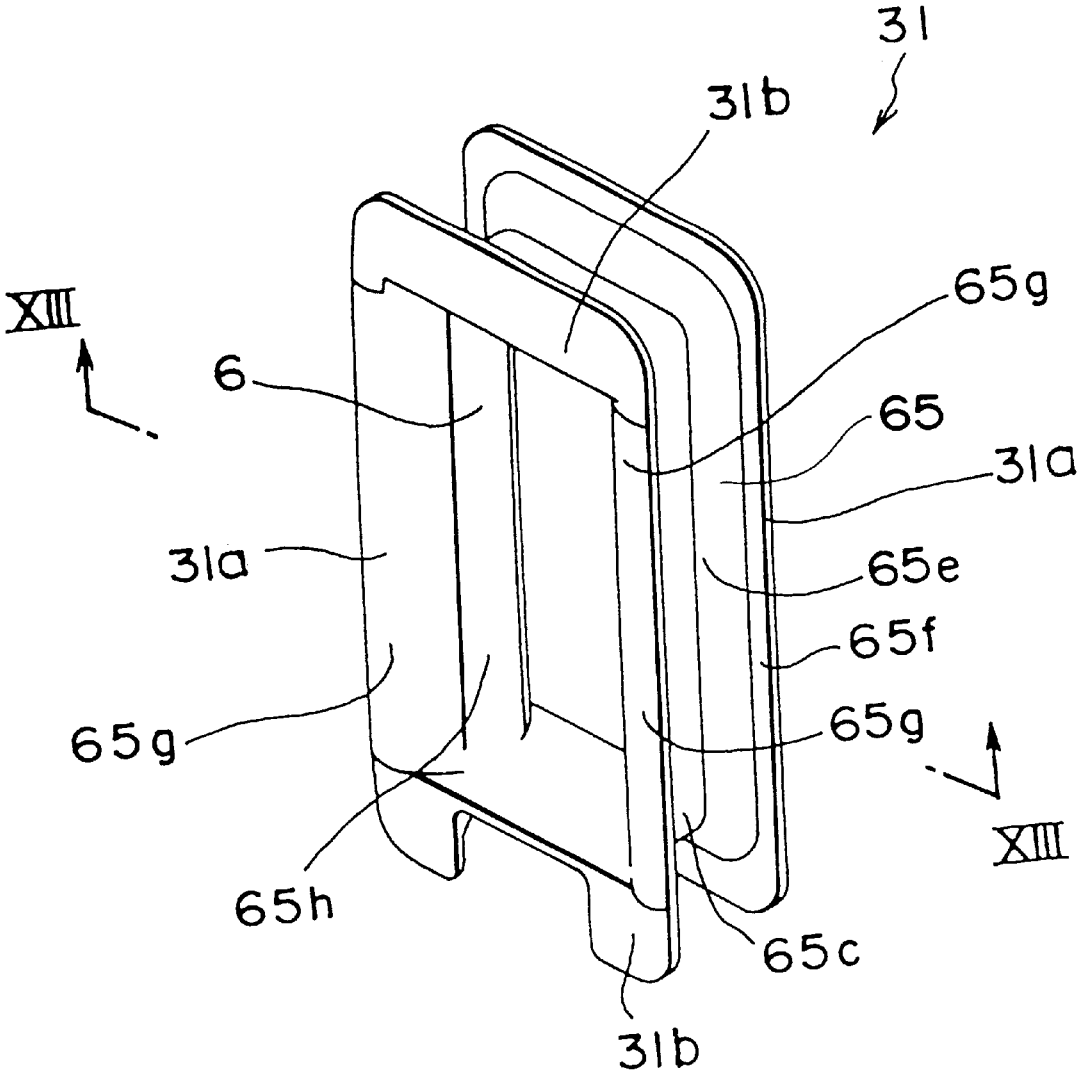
FIG. 12 is a perspective view of a coil bobbin employed in a transformer according to a third embodiment of the present invention.
Figure 13:
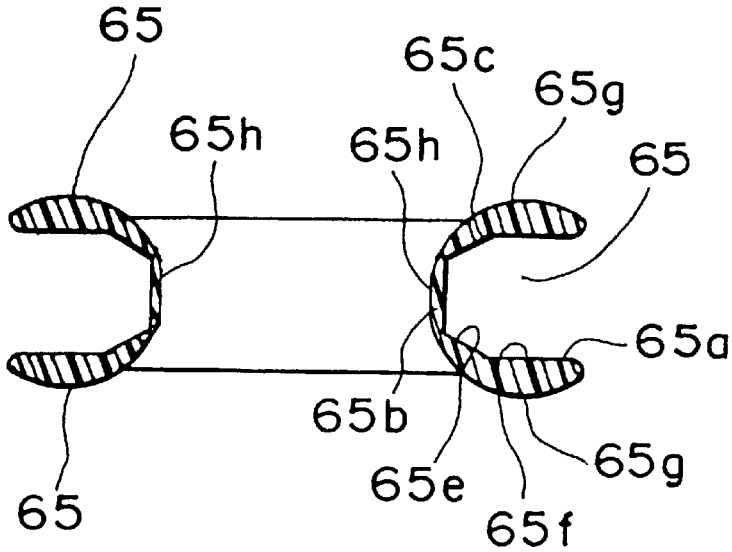
FIG. 13 is a sectional view taken along the line XIII—XIII in FIG. 12.
Figure 14:
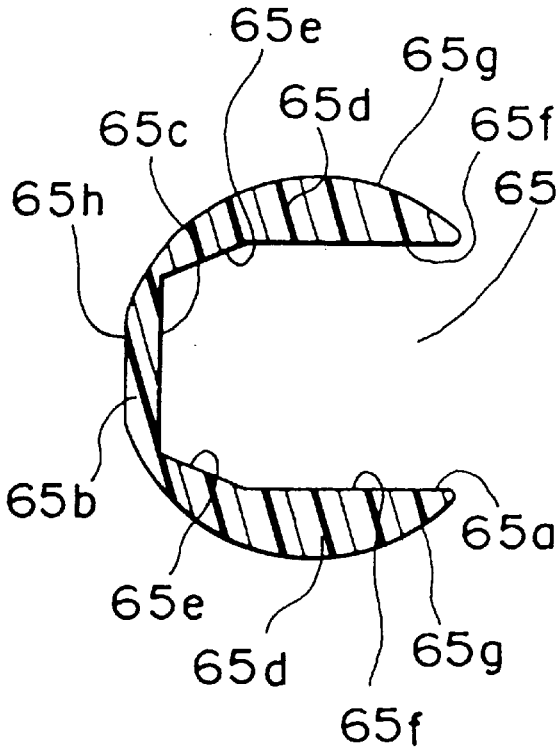
FIG. 14 is an enlarged fragmentary sectional view of FIG. 13.

FIGS. 12 to 14 show a coil bobbin 31 employed in a transformer according to a third embodiment of the present invention. In the above mentioned first and second embodiments, the coil bobbin 31 is a so-called double bobbin in which the inner frame 38 is assembled with the outer frame 37. However, in the third embodiment, the coil bobbin 31 is a so-called single bobbin which is formed by a single bobbin. Namely, in the third embodiment, the coil bobbin 31 includes a pair of parallel rectilinear core winding portions 31*a* and a pair of parallel rectilinear coupling portions 31*b* for coupling the core winding portions 31*a* so as to space the core winding portions 31*a* a predetermined distance from each other. A U-shaped groove 65 is formed on a whole outer periphery of the coil bobbin 31. In the same manner as the first embodiment, the groove 65 is formed into a cross-sectional shape of a channel steel such that the conductors 10 can be closely wound around the groove 65 by the alignment winding method in as wide an area as possible up to inside diameter of the wound cores 35A and 35B.

Namely, the groove 65 has a mouth 65*a* and a bottom wall 65*b* and an inner peripheral surface 65*c* of the bottom wall 65*b* is formed flat. An inner peripheral surface of each of the side walls 65*d* is constituted by a first inner peripheral surface 65*e* connected with the inner peripheral surface 65*c* of the bottom wall 65*b* at an angle of 120° and a second inner peripheral surface 65*f* connected with the first inner peripheral surface 65*e* at an angle of 120°. Meanwhile, an outer peripheral surface 65*g* of each of the side walls 65*d* is curved so as to have a radius of curvature equal to an inside diameter of the wound cores 35A and 35B, while an outer peripheral surface 65*h* of the bottom wall 65*b* is formed flat. Although the frame 60, the windings 34A and 34B and the wound cores 35A and 35B are not illustrated in FIGS. 12 to 14, the conductor 10 is wound, as the winding 34B, around the groove 65 and then, the outer periphery of the winding 34B is coated by the insulating member 57. Subsequently, the conductor 10 is wound, as the winding 34A, around the insulating member 57 on the winding 34B and then, the outer periphery of the winding 34A is coated by the insulating member 57. Other constructions of the third embodiment are identical with those of the first embodiment.

Also in the third embodiment, since the groove 65 is formed into a cross-sectional shape of a channel steel as in the first and second embodiments, the conductors 10 can be closely wound around the groove 65 by the alignment winding method. Meanwhile, since the radius of curvature of the outer peripheral surface 65*g* of each of the side walls 65*d* of the groove 65 at the core winding portion 31*a* is equal to the inside diameter of the wound cores 35A and 35B, outer periphery of the coil bobbin 31 and inner periphery of each of the wound cores 35A and 35B are brought into close contact with each other. Accordingly, heat produced by the windings 34A and 34B is efficiently dissipated through the coil bobbin 31 and the wound cores 35A and 35B. Meanwhile, distortion is not produced in the electromagnetic steel plate 8 wound around the coil bobbin 31 and thus, the wound cores 35A and 35B have excellent magnetic characteristics.

Furthermore, also in the third embodiment, since the outer peripheral surface 65*h* of the bottom wall 65*b* of the groove 65 is formed flat, friction between the electromagnetic steel plate 8 and the coil bobbin 31 is reduced at the time of formation of the wound cores 35A and 35B, the electromagnetic steel plate 8 constituting the wound cores 35A and 35B can be wound around the coil bobbin 31 without residual strain.

Moreover, also in the third embodiment, such a phenomenon can be prevented that insulating property between the windings 34A and 34B and the wound cores 35A and 35B deteriorate due to contact of the winding 34A and 34B with the steel plate coil 7 at the time of formation of the wound cores 35A and 35B.

Figure 15:
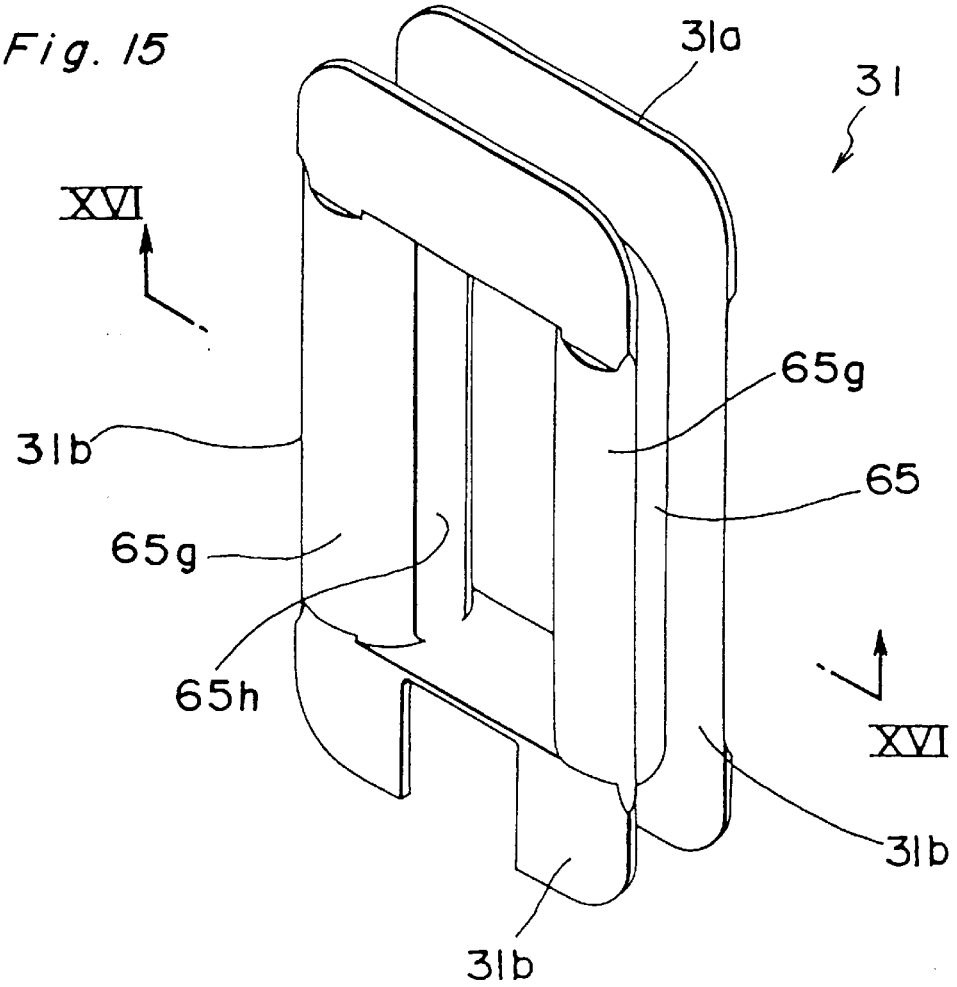
FIG. 15 is a perspective view of a coil bobbin employed in a transformer according to a fourth embodiment of the present invention.
Figure 16:
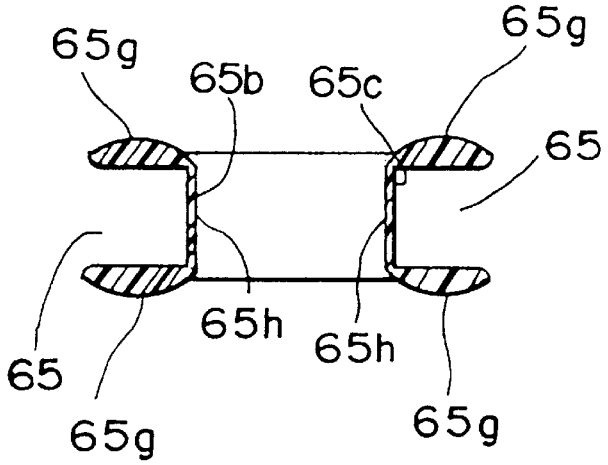
FIG. 16 is a sectional view taken along the line XVI—XVI in FIG. 15.
Figure 17:
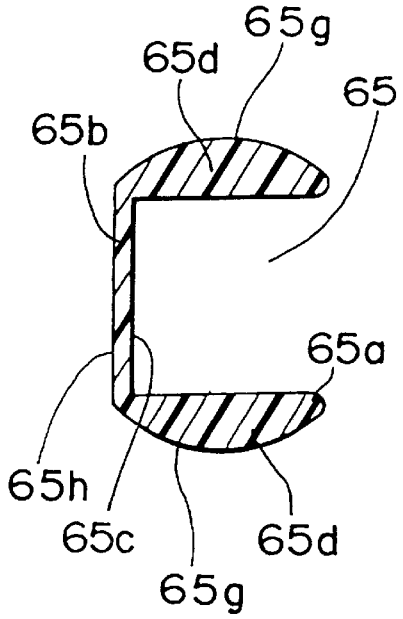
FIG. 17 is an enlarged fragmentary sectional view of FIG. 16.

FIGS. 15 to 17 show a coil bobbin 31 employed in a transformer according to a fourth embodiment of the present invention. The coil bobbin 31 of the fourth embodiment is also a single bobbin similar to that of the third embodiment. In the fourth embodiment, the groove 65 of the coil bobbin 31 has a rectangular cross-sectional shape such that the conductors 10 can be closely wound around the groove 65 by the alignment winding method in as wide an area as possible up to inside diameter of the wound cores 35A and 35B. Other constructions of the fourth embodiment are identical with those of the third embodiment.

Figure 18:
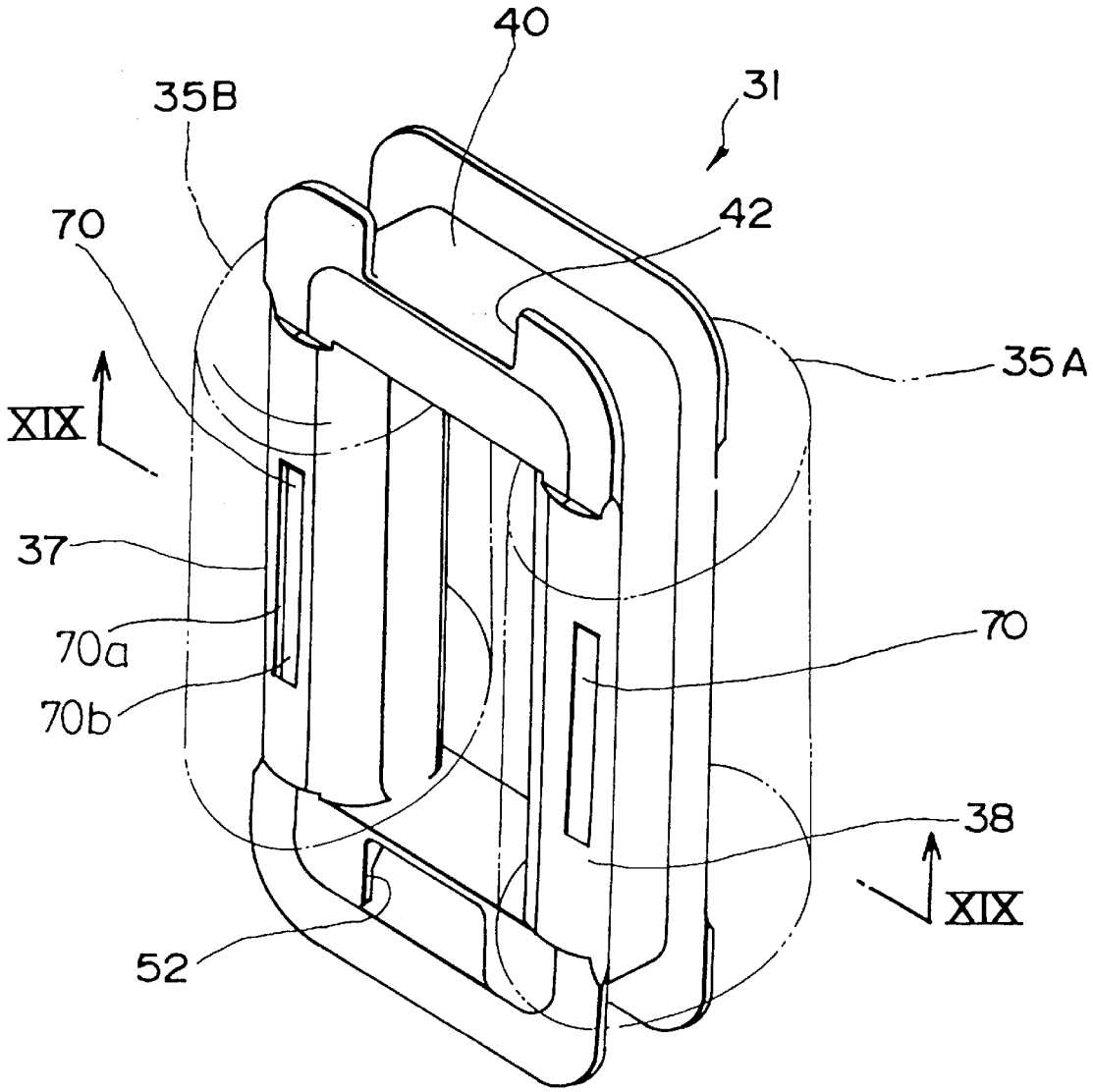
FIG. 18 is a perspective view of a coil bobbin employed in a transformer according to a fifth embodiment of the present invention.
Figure 19:
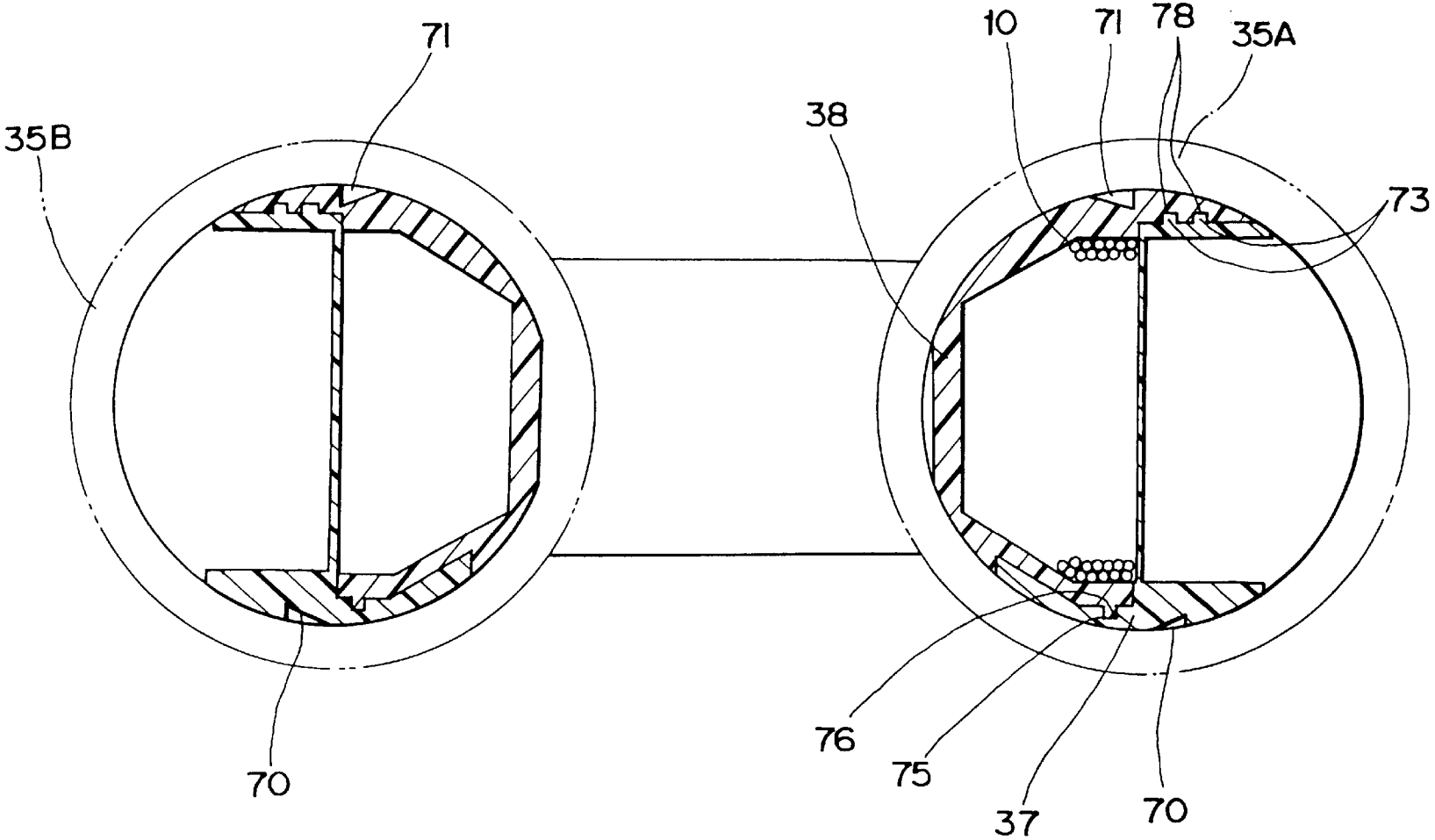
FIG. 19 is a sectional view taken along the line XIX—XIX in FIG. 18.
Figure 20:
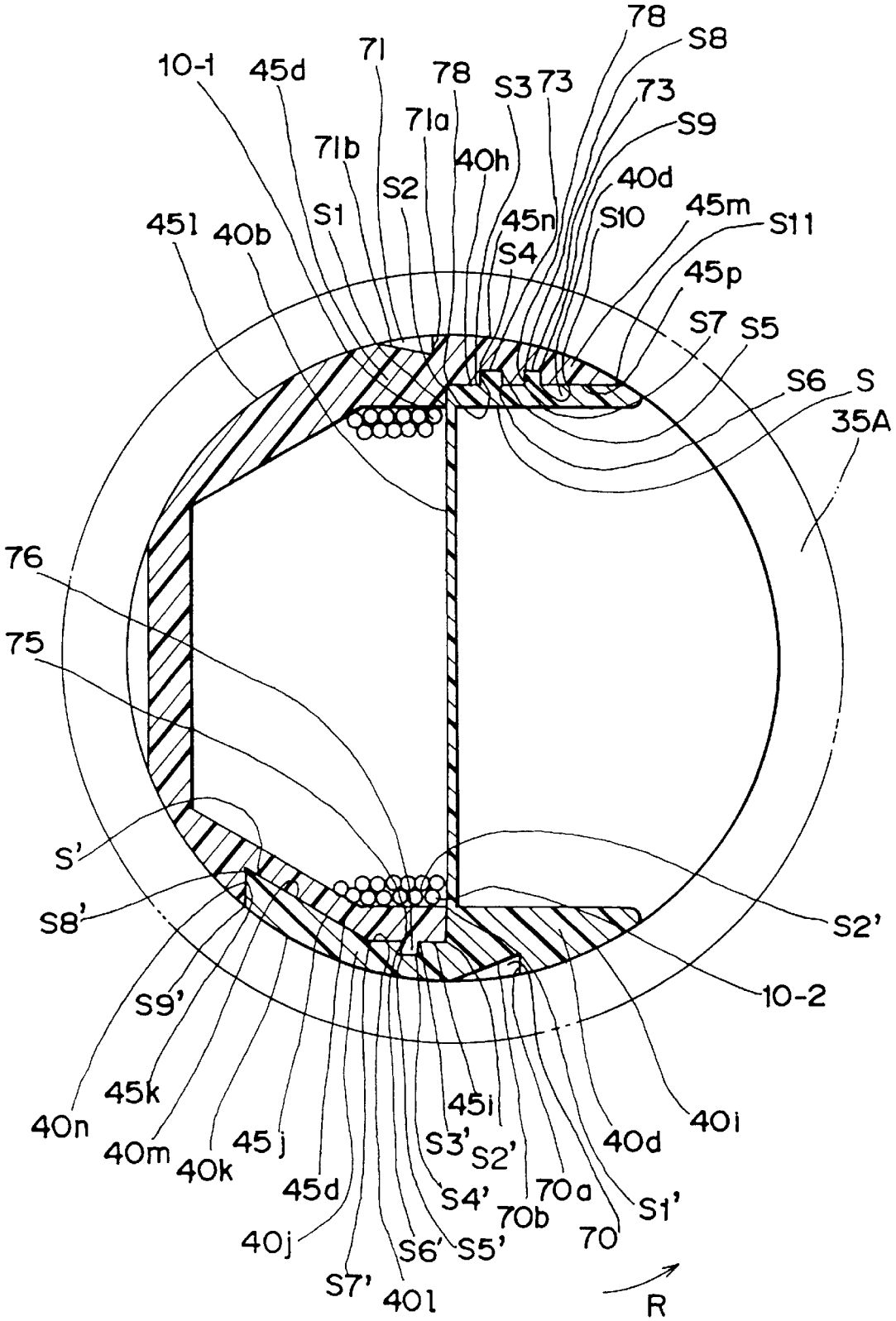
FIG. 20 is an enlarged fragmentary view of FIG. 19.

FIGS. 18 to 20 show a coil bobbin 31 employed in a transformer according to a fifth embodiment of the present invention. In the coil bobbin 31 of the fifth embodiment, the outer and inner frames 37 and 38 similar to those of the first embodiment are formed into cross-sectional shapes different from those of the first embodiment and recesses 70 and 71 engageable with a forward end portion 8*b* of the electromagnetic steel plate 8 constituting the wound cores 35A and 35B are formed at the core winding portions 37*a* and 38*a* of the outer and inner frames 37 and 38.

As shown in FIGS. 19 and 20, in the outer frame 37, one of the side walls 40*d* of the first groove 40 having a cross-sectional shape of a channel steel is formed thin and an outer peripheral surface 40*h* of the thin side wall 40*d* is formed flat. A pair of projections 73 having a rectangular cross-sectional shape and extending longitudinally in parallel with each other are formed on this flat outer peripheral surface 40*h*. On the other hand, in the same manner as the first embodiment, an outer peripheral surface 40*i* of the other side wall 40*d* of the first groove 40 of the outer frame 37 is curved so as to have a radius of curvature equal to an inside diameter of the wound cores 35A and 35B. This side wall 40*d* extends, as a cover portion 40*j*, beyond the bottom wall 40*b* such that the cover portion 40*j* is disposed outside the side wall 45*d* of the inner frame 38. An outer peripheral surface 40*k* of this cover portion 40*j* is curved flush with the outer peripheral surface 40*i* of the side wall 40*d* so as to have the radius of curvature equal to the inside diameter of the wound cores 35A and 35B. On the other hand, an inner periphery of the cover portion 40*j* includes first, second and third flat surfaces 40*l*, 40*m* and 40*n* connected with one another at predetermined angles so as to be flush with an outer peripheral surface of the side wall 45*d* of the inner frame 38 to be described later and thus, defines a polygonal line in cross-sectional shape. A longitudinally extending slot 75 having a rectangular cross-sectional shape is formed on the first flat surface 40*l*.

In the outer frame 38, one of the side walls 45*d* of the second groove 45 having a cross-sectional shape of a channel steel is formed thin. First, second and third flat surfaces 45*i*, 45*j* and 45*k* are formed continuously at predetermined angles on an outer peripheral surface of this thin side wall 45*d* and thus, define a polygonal line in cross-sectional shape. The first, second and third flat surfaces 45*i*, 45*j* and 45*k* are, respectively, brought into close contact with the first, second and third flat surfaces 40*l*, 40*m* and 40*n* constituting the inner periphery of the cover portion 40*j* of the outer frame 37 such that the cover portion 40*j* of the outer frame 37 and the side wall 45*d* of the inner frame 38 are integrally assembled with each other. A longitudinally extending projection 76 having a rectangular cross-sectional shape is provided on the first flat surface 45*i* of the side wall 45*d* and is fitted into a long slot 75 formed on the first flat surface 40*l* of the outer frame 37 such that the outer and inner frames 37 and 38 are held in an assembled state.

On the other hand, in the same manner as the first embodiment, an outer peripheral surface 45*l* of the other side wall 45*d* of the second groove 45 of the inner frame 38 is curved so as to have a radius of curvature equal to the inside diameter of the wound cores 35A and 35B. This side wall 45*d* extends, as a cover portion 45*m*, beyond the mouth 45*a* such that the cover portion 45*m* is disposed outside the side wall 40*d* of the outer frame 37. An outer peripheral surface 45*n* of the cover portion 45*m* is curved so as to have a radius of curvature equal to the inside diameter of the wound cores 35A and 35B, while an inner peripheral surface 45*p* of the cover portion 45*m* is formed flat. Meanwhile, a pair of long slots 78 having a rectangular cross-sectional shape and extending longitudinally in parallel with each other are formed on this inner peripheral surface 45*p* so as to receive the projections 73 provided on the flat outer peripheral surface 40*h* of the side wall 40*d* of the outer frame 37.

In the fifth embodiment, since cross-sectional shapes of the core winding portions 37*a* and 38*a* of the outer and inner frames 37 and 38 are formed as described above, insulating property between the conductors 10 wound around the second groove 45 of the inner frame 38 and the electromagnetic steel plate 8 constituting the wound cores 35A and 35B. Namely, in the fifth embodiment, at a location where one side wall 40*d* of the outer frame 37 and the cover portion 45*m* of the inner frame 38 are joined to each other, a joint face S between the outer and inner frames 37 and 38 extends continuously from a conductor 10-1 disposed closest to the mouth 45*a* in the conductors 10 of the winding 34B of the second groove 45 of the inner frame 38 to the inner peripheral surface of the wound core 35A and defines a polygonal line of points S1 to S11 in cross-sectional shape. Likewise, at a location where the cover portion 40*j* of the outer frame 37 and one side wall 45*d* of the inner frame 38 are joined to each other, a joint face S' between the outer and inner frames 37 and 38 extends continuously from a conductor 10-2 disposed closest to the mouth 45*a* in the conductors 10 in the second groove 45 of the inner frame 38 to the inner peripheral surface of the wound core 35A and defines a polygonal shape of points S1' to S9' in cross-sectional shape.

In case the outer periphery of the winding 34B provided in the second groove 45 of the inner frame 38 is not coated by the insulating member, the winding 34B and the wound core 35A are communicated with each other through minute gaps formed at the joint faces S and S'. Thus, if water or dust penetrates into these minute gaps, insulating property between the windings 34A and 34B and the wound cores 35A and 35B deteriorates and thus, the transformer is not capable of exhibiting desired performance. Therefore, as passages defined at the joint faces S and S' between the outer and inner frames 37 and 38 become larger in length, insulating property between the winding 34B and the wound core 35A is upgraded further. In the fifth embodiment, since the passages at the joint faces S and S' define the polygonal lines in cross-sectional shape as described above, the passages become long for external shapes of the outer and inner frames 37 and 38 and thicknesses of the side walls 40*d* and 45*d* of the first and second grooves 40 and 45. Accordingly, in the fifth embodiment, even if the windings 34A and 34B are not coated by the insulating members, insulating property between the windings 34A and 34B and the wound cores 35A and 35B is excellent.

One of standards for transformers stipulates creeping distance defined by a distance between the conductor (active portion) constituting the winding and the electromagnetic steel plate constituting the wound core, in which the insulating member such as resin is not present but only air is present. Generally, transformers are required to have a creeping distance of not less than a predetermined value. In the fifth embodiment, since the joint faces S and S' between the outer and inner frames 37 and 38 define the polygonal lines in cross-sectional shape as described above, sufficiently long creeping distance can be secured even when size of the outer and inner frames 37 and 38 is small.

In the core winding portions 37*a* of the outer frame 37, the longitudinally extending V-shaped recess 70 is formed on the outer peripheral surface 40*i* of one of the side walls 40*d*, which is formed with the cover portion 40*j*. A flat engageable surface 70*a* directed substantially to the center of the core winding portion 37*a*, i.e., directed substantially perpendicularly to the outer peripheral surface 40*i* of the core winding portion 37*a* is formed at a downstream side of the recess 70 in a winding direction of the arrow R for winding the wound cores 35A and 35B around the core winding portions 37*a*. Meanwhile, in the recess 70, a flat inclined surface 70*b* extends continuously from the engageable surface 70*a* at a predetermined angle.

On the other hand, in the core winding portions 38*a* of the inner frame 38, the longitudinally extending V-shaped recess 71 is formed on the outer side wall 45*l* of one of the side walls 45*d*, which is formed with the cover portion 45*m*. The recess 71 is disposed at a position which is diametrically symmetrical to the recess 70 with respect to the center of the wound core 35A. The recess 71 provided in the inner frame 38 has an engageable surface 71*a* directed substantially to the center of the core winding portion 38*a* and a flat inclined surface 71*b* extending continuously from the engageable surface 71*a* at a predetermined angle. Positions of the engageable surface 71*a* and the inclined surface 71*b* of the recess 71 are opposite to those of the engageable surface 70*a* and the inclined surface 70*b* of the recess 70 formed on the outer frame 37. Thus, the inclined surface 71*b* is formed at a downstream side of the recess 71 in the winding direction of the arrow R. It is preferable that the recesses 70 and 71 have a depth of about 1 mm.

Figure 21:
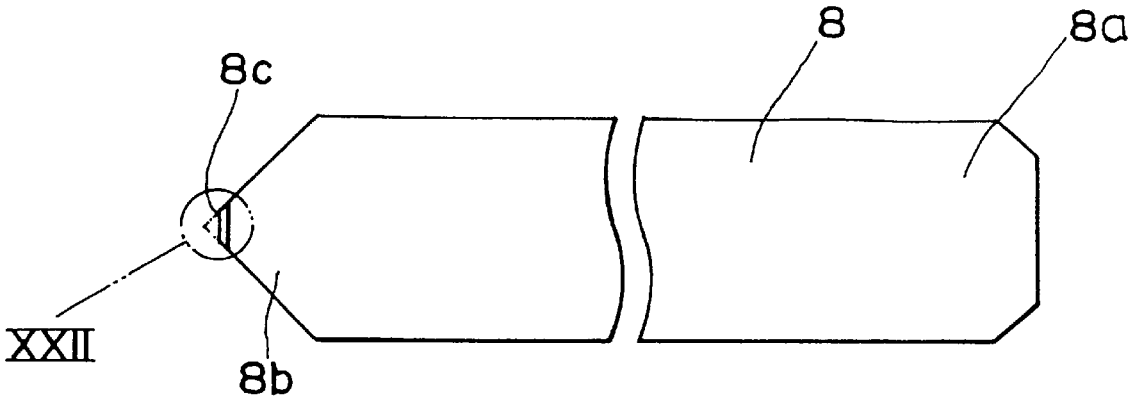
FIG. 21 is a top plan view showing shape of an electromagnetic steel plate employed in the transformer of FIG. 18.
Figure 22:
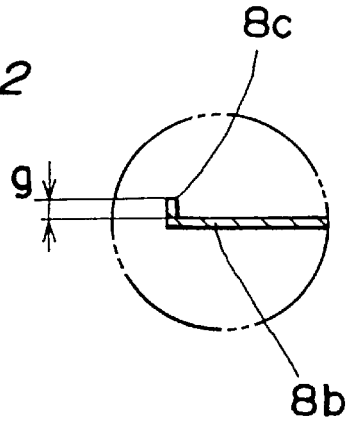
FIG. 22 is an enlarged top plan view of a portion XXII of the electromagnetic steel plate of FIG. 21.
Figure 23:
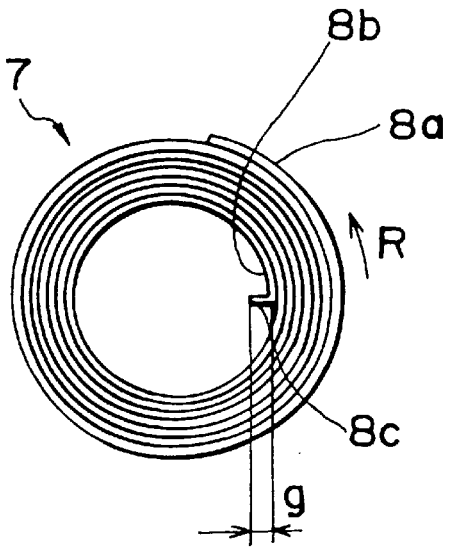
FIG. 23 is a top plan view of a steel plate coil employed in the transformer of FIG. 18.
Figure 24:
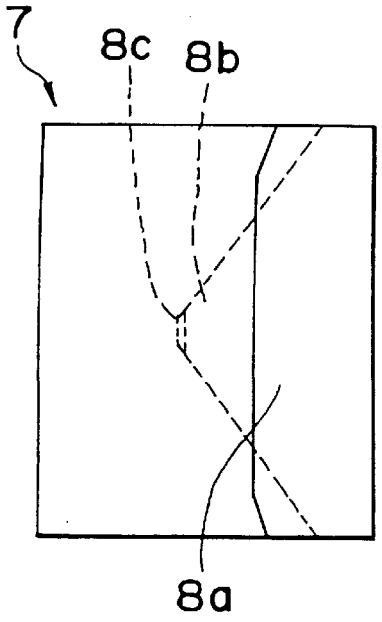
FIG. 24 is a side elevational view of the steel plate coil of FIG. 23.

Meanwhile, in the fifth embodiment, the forward end portion 8*b* of the electromagnetic steel plate 8 constituting the cylindrical wound cores 35A and 35B is formed into a triangular shape which becomes gradually smaller in width towards a distal end of the forward end portion 8*b* as shown in FIGS. 21 and 22. Furthermore, the distal end of the forward end portion 8*b* is bent substantially orthogonally so as to form an engageable portion 8*c*. A thickness g of this engageable portion 8*c* is so set as to be smaller than the depth of the recesses 70 and 71. On the other hand, a rearward end portion 8*a* of the electromagnetic steel plate 8 is formed into a trapezoidal shape which becomes gradually smaller in width towards a distal end of the rearward end portion 8*a*. As shown in FIGS. 23 and 24, the electromagnetic steel plate 8 is wound into the steel plate coil 7 such that the forward end portion 8*b* having the engageable portion 8*c* and the rearward end portion 8*a* are disposed at inner and outer peripheral sides of each of the wound cores 35A and 35B, respectively.

Figure 25A:
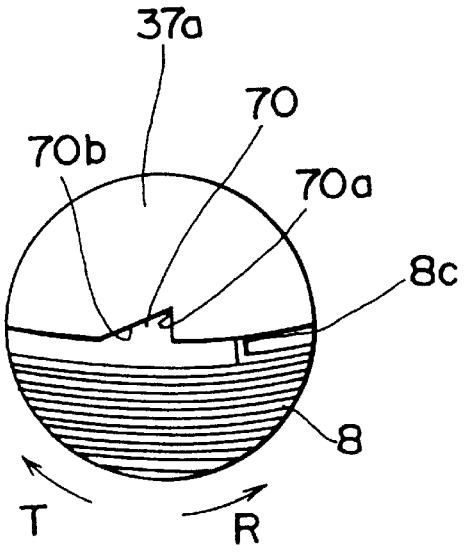
FIGS. 25A and 25B are enlarged views explanatory of operation of fixing of a wound core in the transformer of FIG. 18.
Figure 25B:
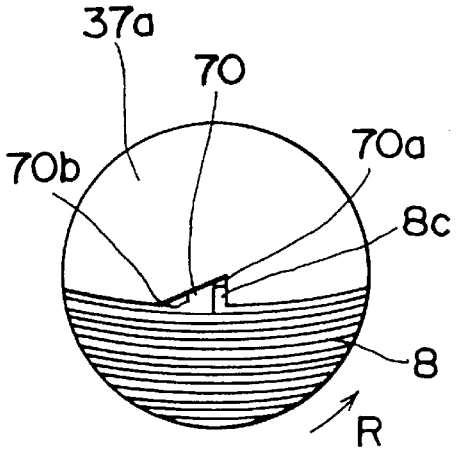

When the electromagnetic steel plate 8 has been wound around the core winding portions 37*a* and 38*a* by steps shown in FIGS. 35A to 35D, the engageable portion 8*c* is brought into contact with surface of the core winding portion 37*a* as shown in FIG. 25A. Then, if each of the wound cores 35A and 35B is rotated in the direction of the arrow T in FIG. 25A, the engageable portion 8*c* is fitted into the recess 70 as shown in FIG. 25B, so that rotation of the wound cores 35A and 35B relative to the core winding portions 37*a* and 38*a* is prevented through engagement of the engageable portion 8*c* with the recess 70 and thus, the wound cores 35A and 35B are fixed to the core winding portions 37*a* and 38*a*.

Thus, in the fifth embodiment, the wound cores 35A and 35B can be fixed to the core winding portions 37*a* and 38*a* by merely rotating the wound cores 35A and 35B wound around the core winding portions 37*a* and 38*a*, thereby resulting in excellent operating efficiency. Meanwhile, if the engageable portion 8*c* is brought into engagement with the recess 70 as described above, the wound cores 35A and 35B are prevented from being rotated relative to the core winding portions 37*a* and 38*b* and thus, are held in close contact with the core winding portions 37*a* and 38*a*.

Meanwhile, in case the electromagnetic steel plate 8 constituting the wound cores 35A and 35B is wound in a direction opposite to the direction of the arrow R, i.e., in the direction of the arrow T, the engageable portion 8*c* of the electromagnetic steel plate 8 is brought into engagement with the recess 71. In this case, when the wound cores 35A and 35B are rotated in the direction of the arrow R after the wound cores 35A and 35B have been wound around the core winding portions 35A and 35B, the engageable portion 8*c* is brought into engagement with the recess 71.

Figure 26:
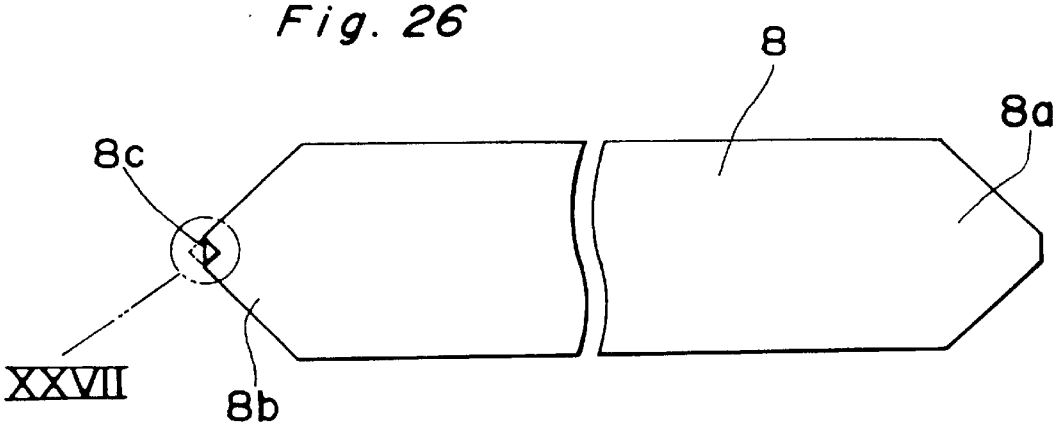
FIG. 26 is a top plan view showing another example of the electromagnetic steel plate of FIG. 21.
Figure 27:
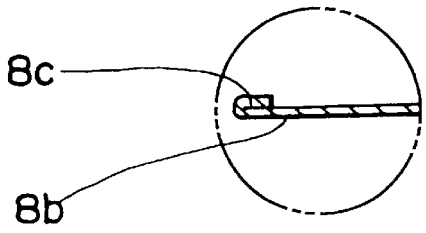
FIG. 27 is an enlarged top plan view of a portion XXVII of the electromagnetic steel plate of FIG. 26.
Figure 28:
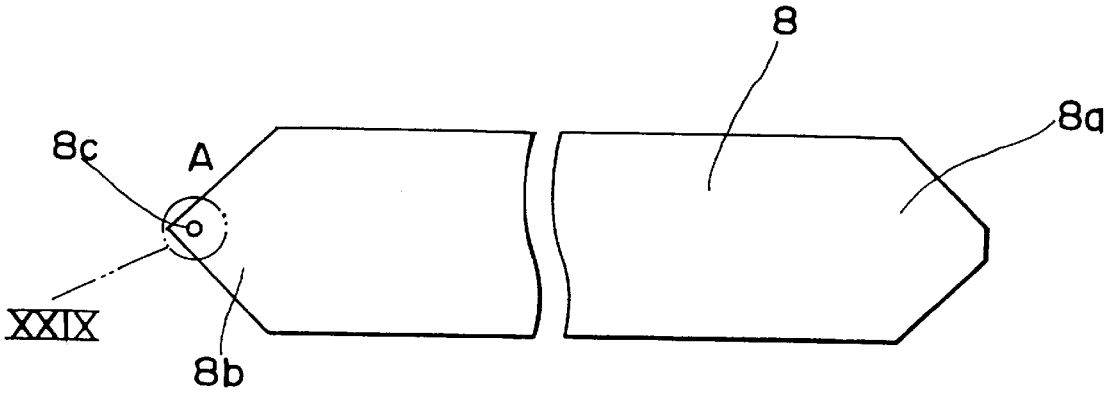
FIG. 28 is a top plan view showing still another example of the electromagnetic steel plate of FIG. 21.
Figure 29:
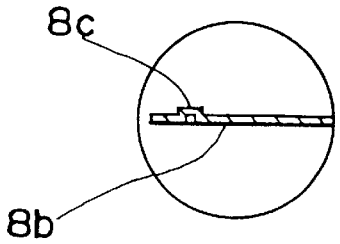
FIG. 29 is an enlarged top plan view of a portion XXIX of the electromagnetic steel plate of FIG. 28.

The engageable portion 8*c* is not structurally restricted to that shown in FIGS. 21 and 22 but may be arranged such that the electromagnetic steel plate 8 partially projects in a direction of its width at the forward end portion 8*b*. For example, as shown in FIGS. 26 and 27, the forward end portion 8*b* of the electromagnetic steel plate 8 constituting the wound cores 35A and 35B may be folded back through a short length such that the electromagnetic steel plate 8 is overlapped. The engageable portion 8*c* formed by this overlap portion of the electromagnetic steel plate 8 is brought into engagement with the recesses 70 and 71 formed on the core winding portions 37*a* and 38*a*. Furthermore, as shown in FIGS. 28 and 29, by punching a distal end of the forward end portion 8*b* of the electromagnetic steel plate 8, the electromagnetic steel plate 8 may be projected circularly such that the engageable portion 8*c* formed by this projected portion is brought into engagement with the recesses 70 and 71 formed on the core winding portions 37*a* and 38*a*. Since other constructions of the fifth embodiment are similar to those of the first embodiment, the description is abbreviated for the sake of brevity.

Figure 30A:
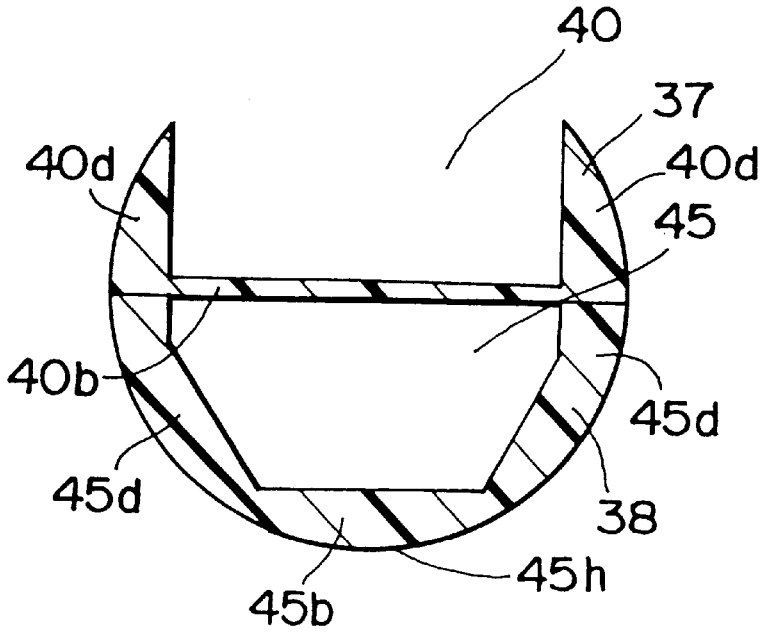
Figure 30B:
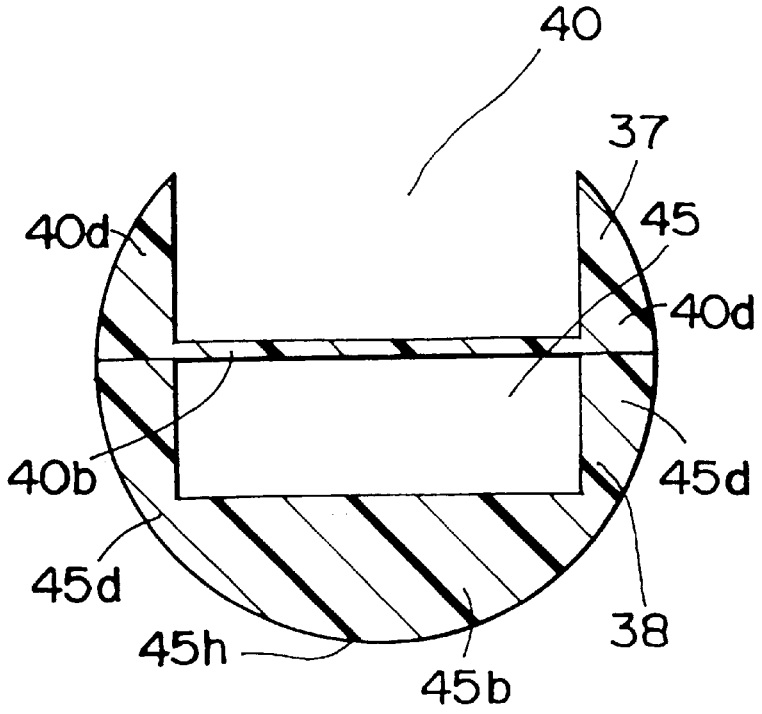

The present invention is not restricted to the above described embodiments but can be modified variously. Initially, the cross-sectional shapes of the core winding portions 37*a*, 38*a* and 31*a* are not restricted to those of the above described embodiments. For example, in the double bobbin including the outer and inner frames 37 and 38, the core winding portions 37*a* and 38*a* may have cross-sectional shapes shown in FIGS. 30A to 30F. In FIG. 30A, each of the first and second grooves 40 and 45 has a cross-sectional shape of a channel steel in the same manner as the first embodiment but the outer peripheral surface 45*h* of the bottom wall 45*b* of the second groove 45 of the outer frame 38 is curved so as to have an arcuate cross-sectional shape. In FIG. 30B, each of the first and second grooves 40 and 45 has a rectangular cross-sectional shape in the same manner as the second embodiment but the outer peripheral surface 45*h* of the bottom wall 45*b* of the second groove 45 of the inner frame 38 is curved so as to have an arcuate cross-sectional shape.

Figure 30C:
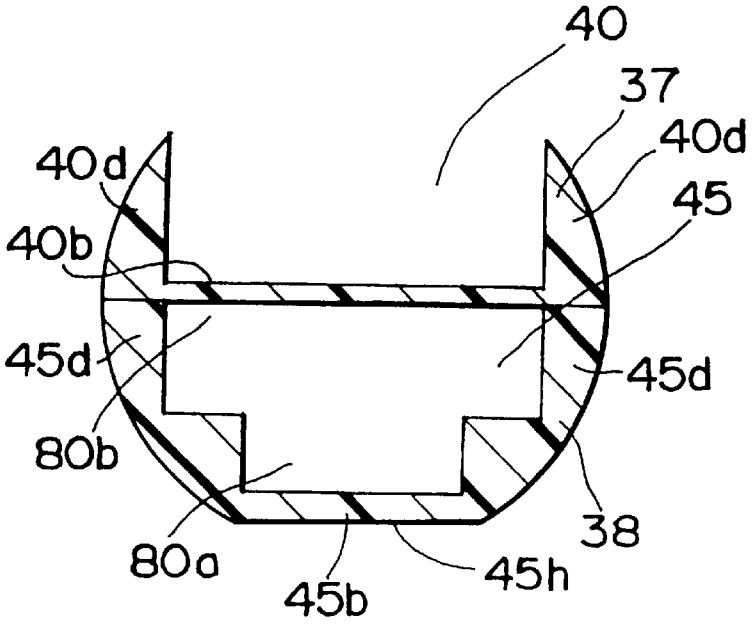
Figure 30D:
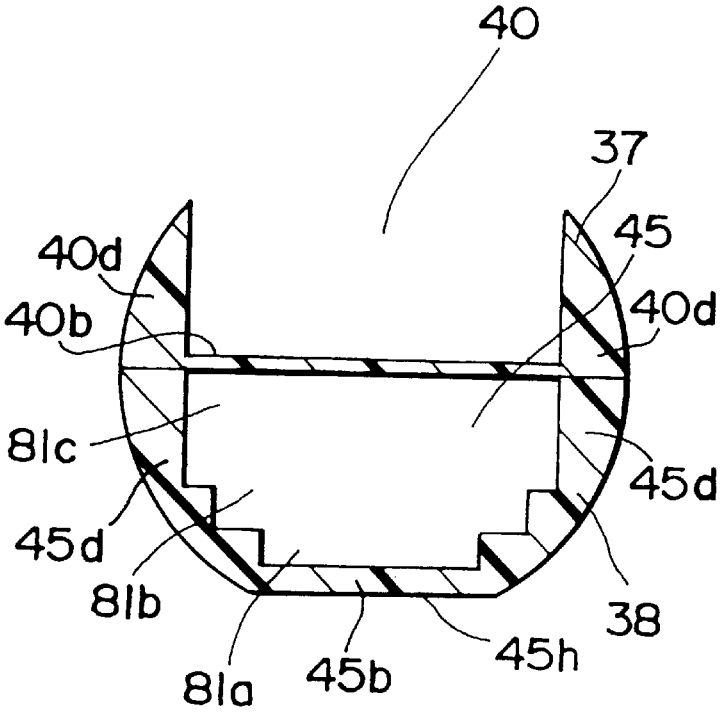
Figure 30E:
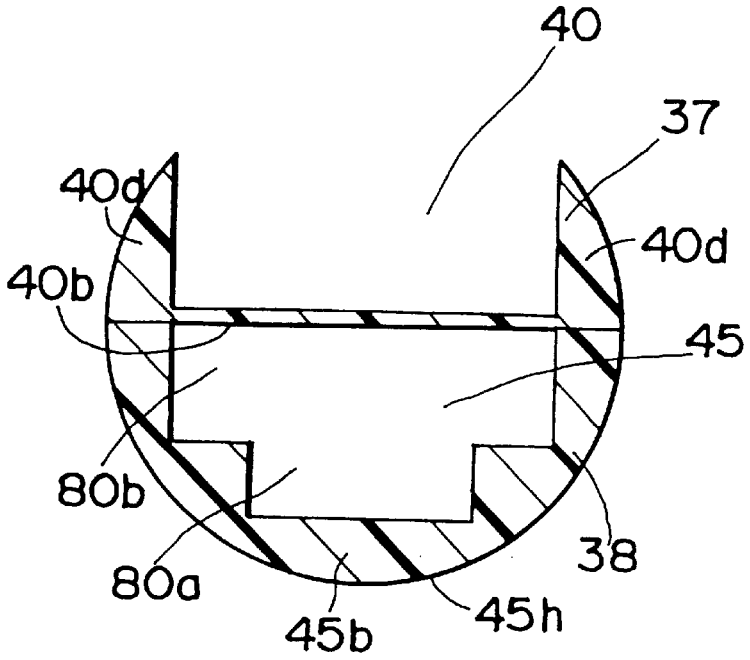
Figure 30F:
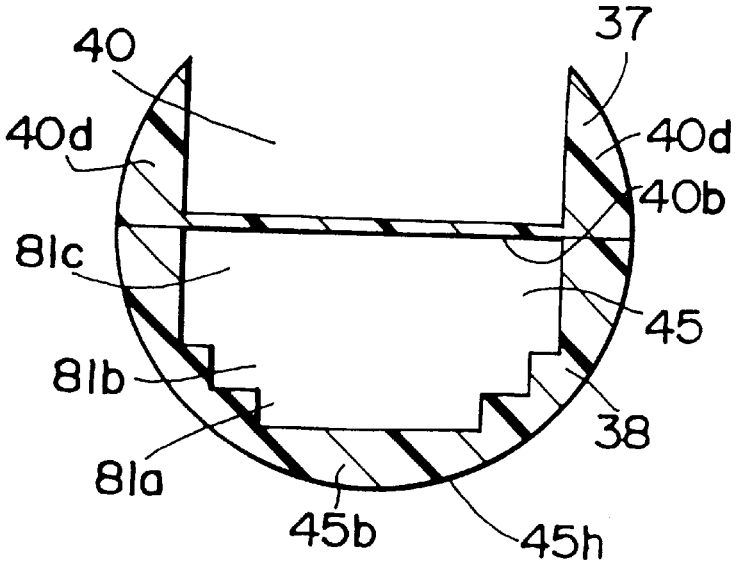

In FIG. 30C, a cross-sectional shape of the second groove 45 of the inner frame 38 includes a first rectangular portion 80*a* formed adjacent to the bottom wall 45*b* and a second rectangular portion 80*b* formed adjacent to the mouth 45*a* and wider than the first rectangular portion 80*a* continuously with the first rectangular portion 80*a*, while the first groove 40 of the outer frame 37 has a rectangular cross-sectional shape having a width equal to that of the second rectangular portion 80*b* of the inner frame 38. In FIG. 30D, a cross-sectional shape of the second groove 45 of the inner frame 38 includes first, second and third rectangular portions 81*a*, 81*b* and 81*c* formed wider sequentially in this order continuously from the bottom wall 45*b* to the mouth 45*a*, while the first groove 40 of the outer frame 37 has a rectangular cross-sectional shape having a width equal to that of the third rectangular portion 81*c*. Cross-sectional shapes of the first and second grooves 40 and 45 in FIG. 30E are identical with those of FIG. 30C but FIG. 30E is different from FIG. 30C in that in FIG. 30E, the outer peripheral surface 45*h* of the bottom wall 45*b* of the second groove 45 of the inner frame 38 is curved so as to have an arcuate cross-sectional shape. Likewise, cross-sectional shapes of the first and second grooves 40 and 45 in FIG. 30F are identical with those of FIG. 30D but FIG. 30F is different from FIG. 30D in that in FIG. 30F, the outer peripheral surface 45*h* of the bottom wall 45*b* of the second groove 45 of the inner frame 38 is curved so as to have an arcuate cross-sectional shape.

Figure 31A:
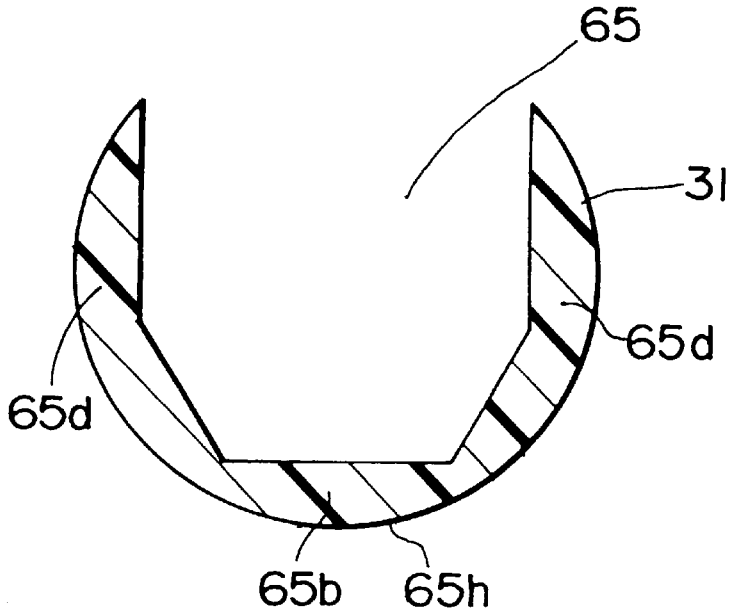
FIGS. 31A to 31F are sectional views showing other examples of a single coil bobbin, respectively.
Figure 31B:
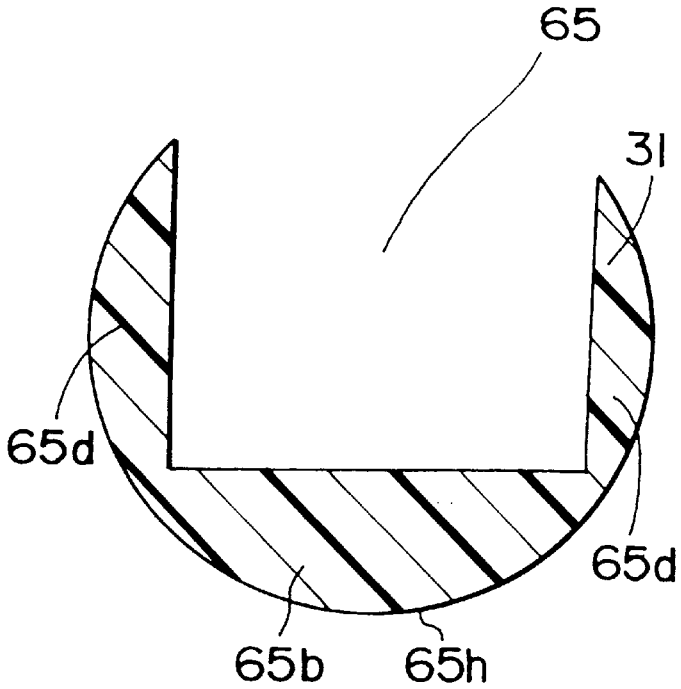
Figure 31C:
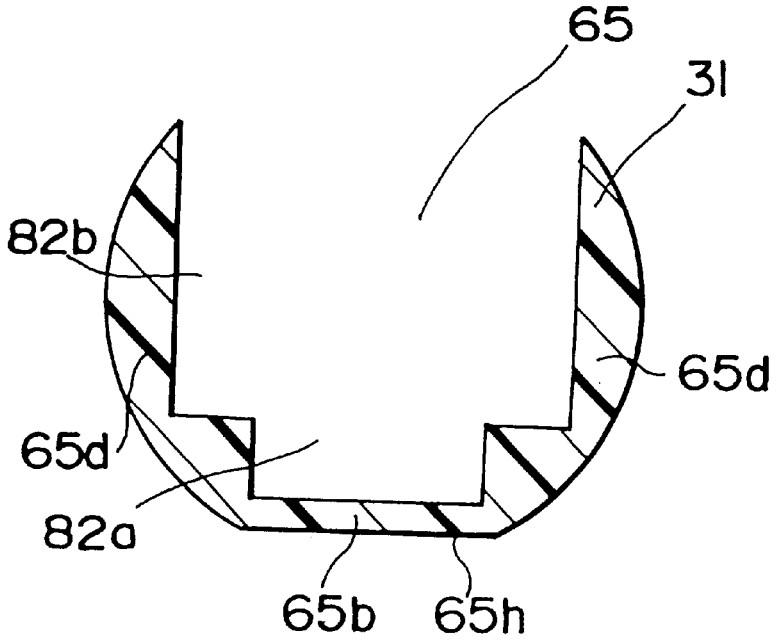
Figure 31D:
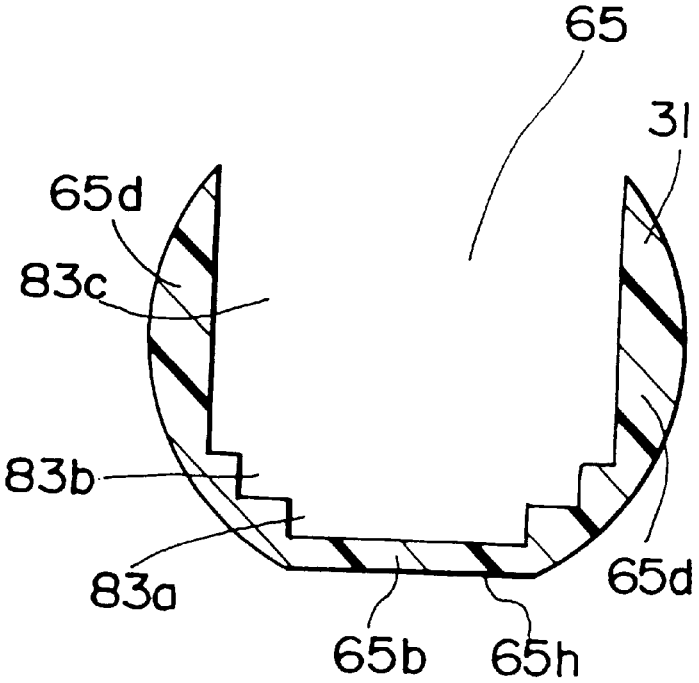
Figure 31E:
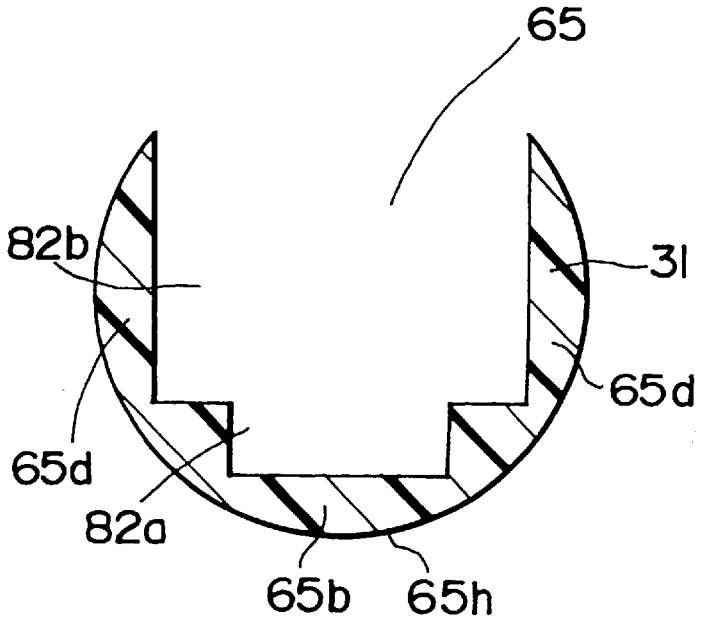
Figure 31F:
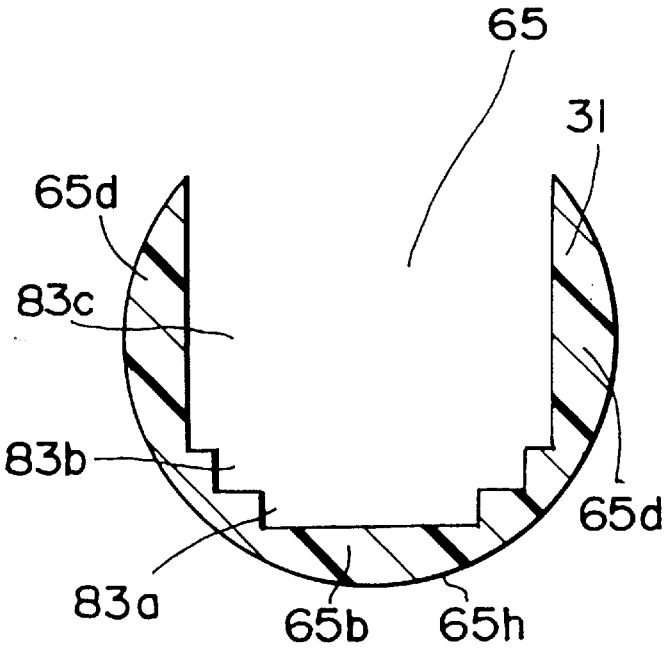

On the other hand, in the case of a single bobbin, the core winding portion 31*a* may have cross-sectional shapes shown in FIGS. 31A to 31F. In FIG. 31A, the groove 65 has a cross-sectional shape of a channel steel in the same manner as the third embodiment but the outer peripheral surface 65*h* of the bottom wall 65*b* of the groove 65 is curved so as to have an arcuate cross-sectional shape. In FIG. 31B, the groove 65 has a rectangular cross-sectional shape in the same manner as the fourth embodiment but the outer peripheral surface 65*h* of the bottom wall 65*b* of the groove 65 is curved so as to have an arcuate cross-sectional shape. In FIG. 31C, a cross-sectional shape of the groove 65 includes a first rectangular portion 82*a* formed adjacent to the bottom wall 45*b* and a second rectangular portion 82*b* formed adjacent to the mouth 65*a* and wider than the first rectangular portion 82*a* continuously with the first rectangular portion 82*a*. In FIG. 31D, a cross-sectional shape of the groove 65 has first, second and third rectangular portions 83*a*, 83*b* and 83*c* formed wider sequentially in this order continuously from the bottom wall 65*b* to the mouth 65*a*. A cross-sectional shape of the groove 65 in FIG. 31E is identical with that of FIG. 31C but FIG. 31E is different from FIG. 31C in that in FIG. 31E, the outer peripheral surface 65*h* of the bottom wall 65*b* of the groove 65 is curved so as to have an arcuate cross-sectional shape. Similarly, a cross-sectional shape of the groove 65 in FIG. 31F is identical with that of FIG. 31D but FIG. 31F is different from FIG. 31D in that in FIG. 31F, the outer peripheral surface 65*h* of the bottom wall 65*b* of the groove 65 is curved so as to have an arcuate cross-sectional shape.

As described above, the grooves 40, 45 and 65 formed on the coil bobbin 31 can be modified variously and may be of any shape in which the conductor 10 can be wound by the alignment winding method of FIG. 36 and width of the grooves 40, 45 and 65 is constant from the bottom walls 40*b*, 45*b* and 65*b* to the mouths 40*a*, 45*a* and 65*a* or is increased from the bottom wall 40*b*, 45*b* and 65*b* towards the mouths 40*a*, 45*a* and 65*a* continuously or stepwise.

Figure 32:
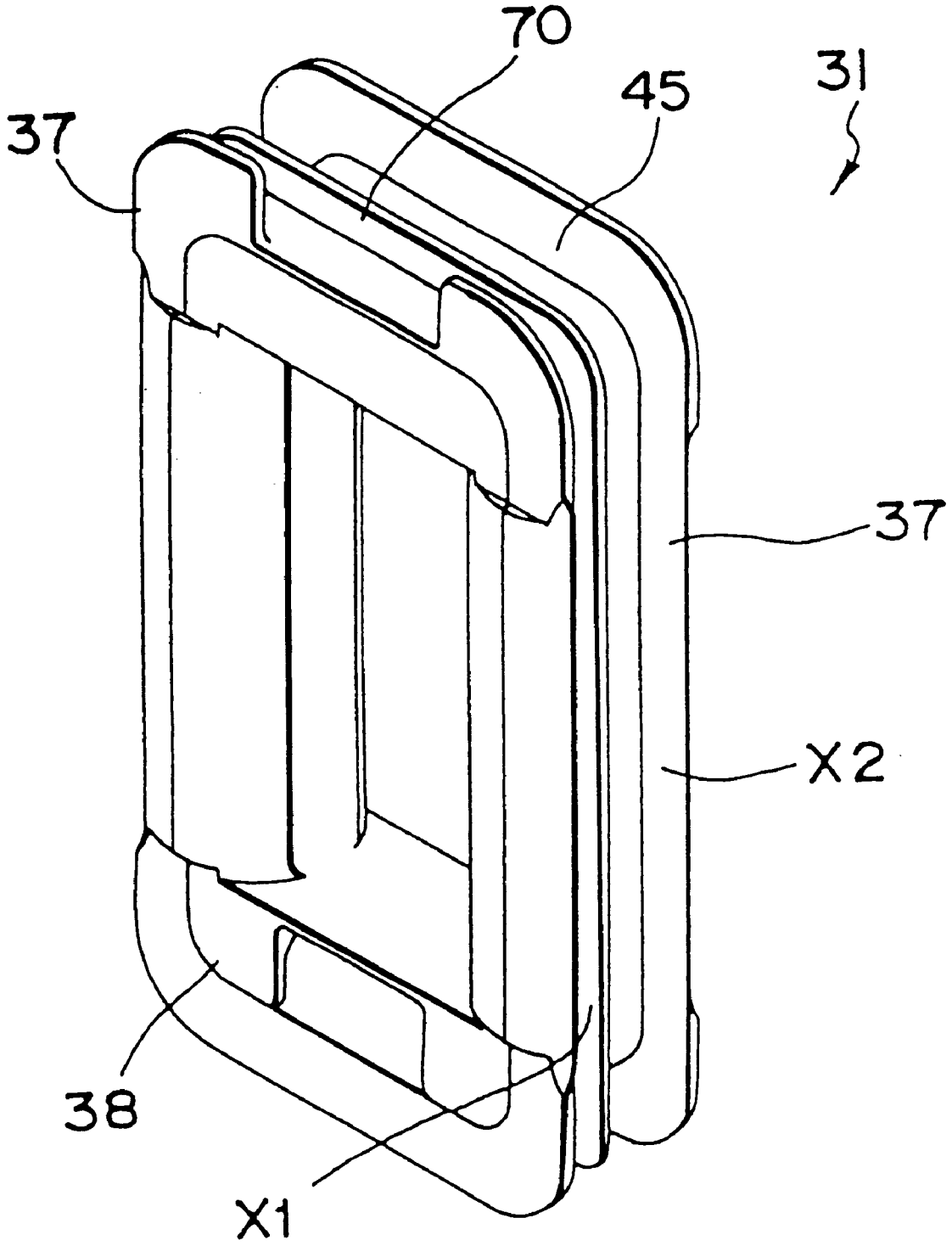
FIG. 32 is a perspective view showing a coil bobbin employed in a transformer which is a modification of the transformer of FIG. 1.
Figure 33:
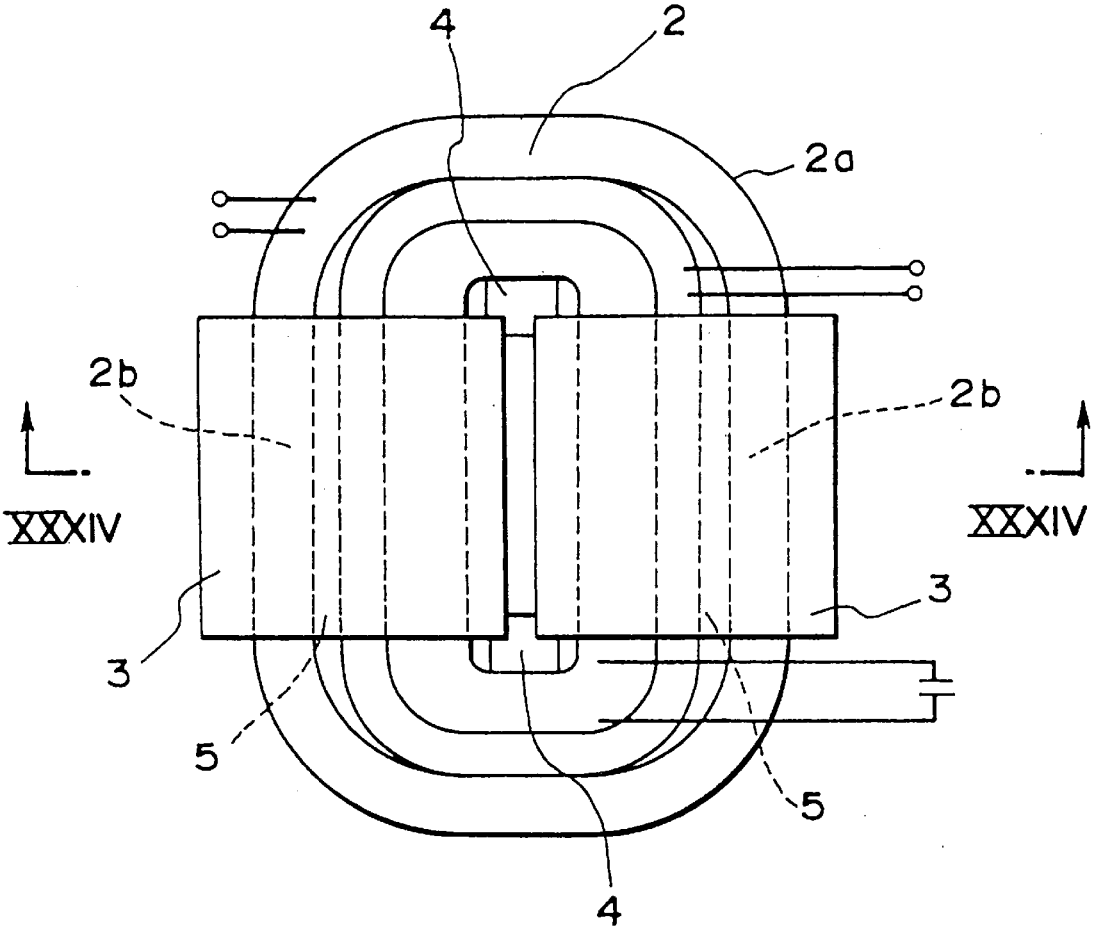
Fig. 33 PRIOR ART
FIG. 33 is a schematic view of a prior art transformer.
Figure 34:
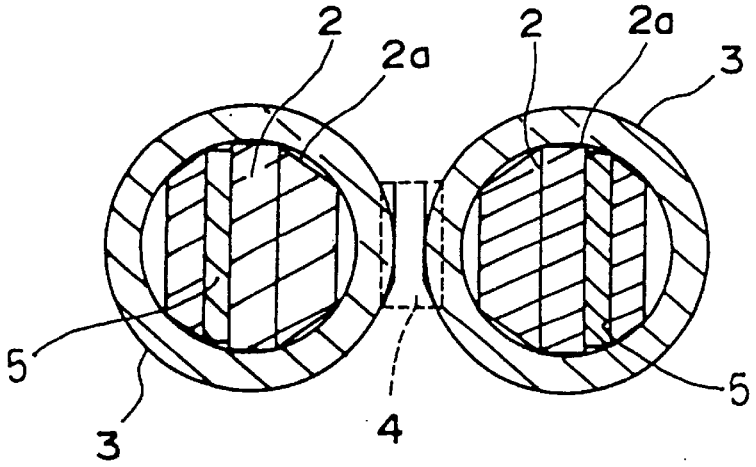
Fig. 34 PRIOR ART
FIG. 34 is a sectional view taken along the line XXXIV—XXXIV in FIG. 33.
Figure 35A:
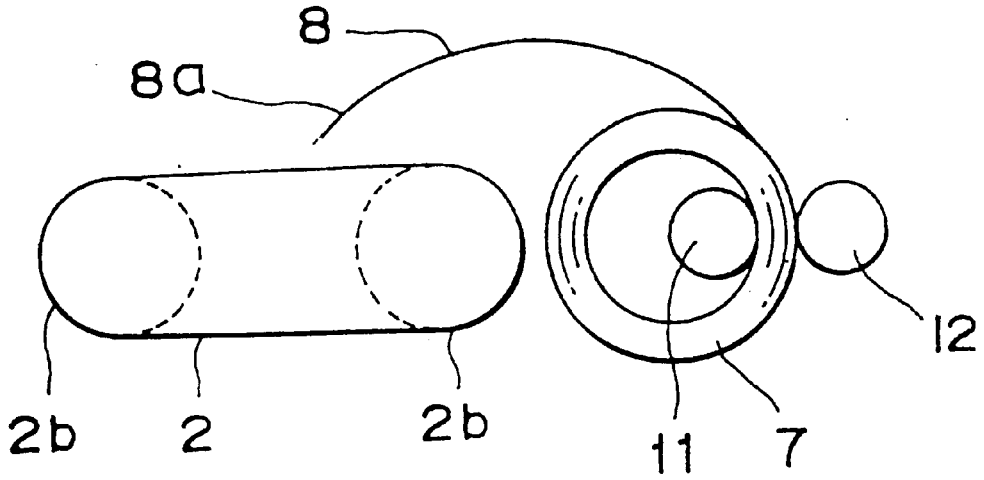
Fig. 35A PRIOR ART
FIGS. 35A to 35D are schematic views explanatory of steps of operation of forming a wound core of the prior art transformer of FIG. 33.
Figure 35B:
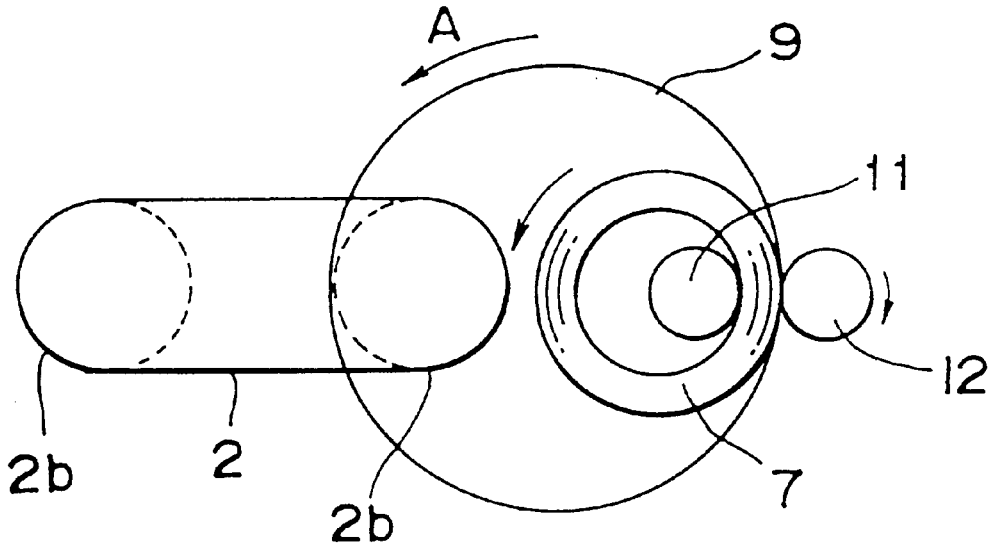
Fig. 35B PRIOR ART
Figure 35C:
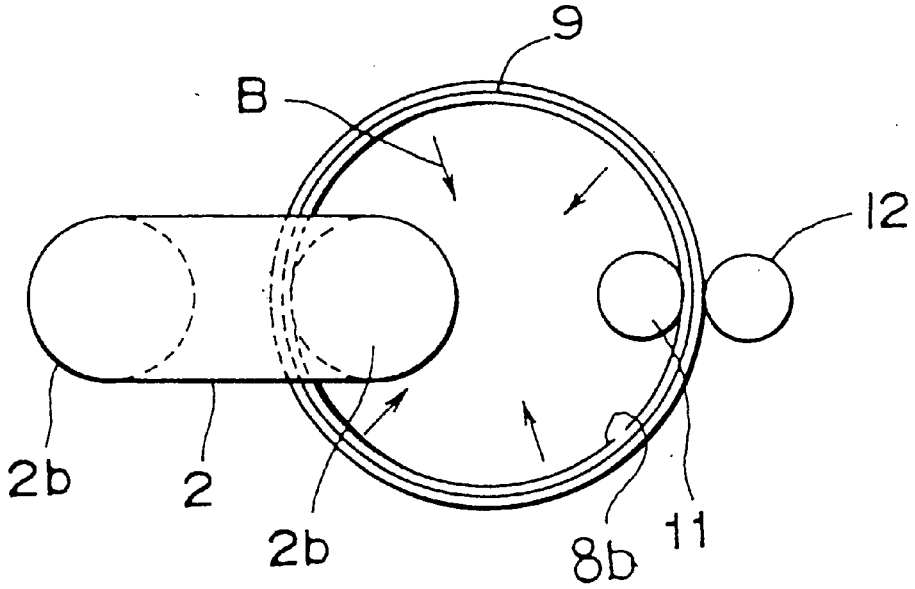
Fig. 35C PRIOR ART
Figure 35D:
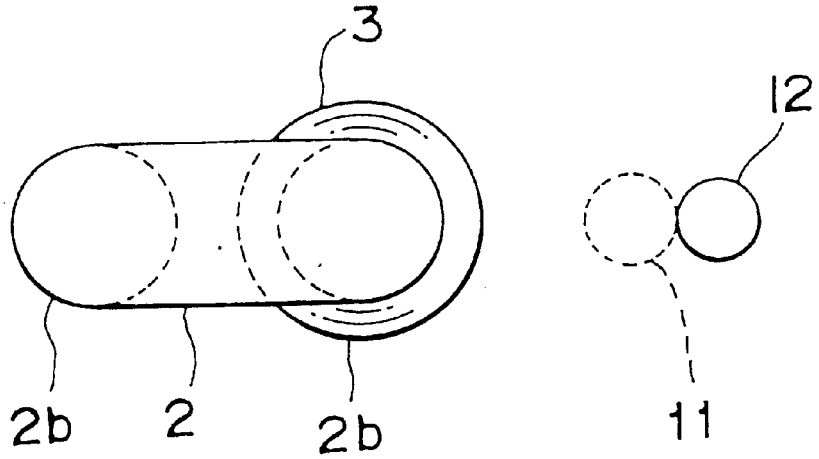
Fig. 35D PRIOR ART

Furthermore, as shown in FIG. 32, the outer frame 37 of the coil bobbin 31 of the first embodiment may be formed with a partition plate 70 for widthwise dividing the first groove 40 into portions X1 and X2. In this case, different windings can be wound around the portions X1 and X2, respectively and can be electrically insulated from each other positively. Meanwhile, the partition plate 70 may also be provided on the second groove 45 of the inner frame 38 or the groove 65 of the single bobbin.

Hereinafter, effects gained in the present invention are described. Since the outer peripheral surface of each of the opposite side walls of the groove at the core winding portions is curved so as to have an arcuate cross-sectional shape, the wound cores are brought into close contact with the outer periphery of the coil bobbin and thus, heat produced by the winding can be efficiently dissipated through the coil bobbin and the wound cores.

Especially, since the outer peripheral surface of each of the side walls of the groove at the core winding portions has the radius of curvature equal to the inside diameter of the wound cores, the wound cores are positively brought into close contact with the outer periphery of the coil bobbin, heat produced by the winding is further efficiently dissipated through the coil bobbin and the wound cores. As a result, rise of temperature of the winding can be reduced and thus, the transformer can be made compact. Furthermore, since the inside diameter of the wound cores can be precisely set to a desired value, residual strain is not produced in the electromagnetic steel plate constituting the wound core and thus, magnetic characteristics of the electromagnetic steel plate constituting the wound core can be improved.

Since the outer peripheral surface of the bottom wall of the groove is formed flat, friction between the electromagnetic steel plate and the coil bobbin produced at the time when the electromagnetic steel plate is wound around each of the core winding portions of the coil bobbin is reduced, so that a large ring formed for this winding can be reduced in diameter and thus, the electromagnetic steel plate can be wound around each of the core winding portions without distorting the electromagnetic steel plate greatly. Therefore, magnetic characteristics of the electromagnetic steel plate constituting the wound core can be further improved.

Since the width of the mouth of the groove is not less than the width of the bottom wall of the groove in the cross-sectional shape of the groove, the conductor can be closely wound in the alignment winding method easily and thus, heat produced by the winding can be further efficiently dissipated through the coil bobbin and the wound cores.

Since the groove is formed into the cross-sectional shape of the channel steel such that the bottom wall of the groove is connected with each of the side walls of the groove at an angle of 120°, the conductor constituting the winding can be easily wound in the aligned manner in a large area within the inside diameter of the wound cores.

Since the groove is formed into the rectangular cross-sectional shape, the conductor constituting the winding can be closely wound in the aligned manner easily in a large area within the inside diameter of the wound cores.

Since the coil bobbin is obtained by assembling the inner frame with the outer frame, electrical insulation between the winding wound around the outer frame and the winding wound around the inner frame can be improved.

Since the cross-sectional shape of the joint face between the outer and inner frames of the coil bobbin defines the polygonal line, shortcircuiting between the winding wound around the inner frame and the wound core due to penetration of water or dust into the gap formed at the joint face is prevented and thus, electrical insulation between the winding wound around the inner frame and the wound core can be improved.

Since each of the core winding portions and the coupling portions of the coil bobbin extends rectilinearly, the winding can be wound around the groove easily.

Since the recess for receiving the engageable portion provided at the end portion of the electromagnetic steel plate constituting each of the wound cores is formed on the core winding portions of the coil bobbin, rotation of the wound cores relative to the core winding portions is prevented and the wound cores are closely secured to the core winding portions positively, so that efficient dissipation of heat produced by the winding and excellent magnetic characteristics of the electromagnetic steel plate constituting each of the wound cores are secured. Meanwhile, when the wound core is rotated after the wound core has been wound around the core winding portion in case the recess for receiving the engageable portion is formed on the core winding portion, the engageable portion is fitted into the recess so as to fix the wound core to the core winding portion in unrotative state. As a result, the wound core can be secured to the core winding portion easily, thereby resulting in improvement of operating efficiency.

In the wound core, the engageable portion is provided at the end portion of the inner periphery of the wound core. Therefore, when the wound core is rotated after the wound core has been wound around the core winding portion of the coil bobbin, the engageable portion is fitted into the recess formed on the coil bobbin, so that rotation of the wound core relative to the core winding portion is prevented and the wound core is closely secured to the core winding portion. Meanwhile, since the wound core is fixed to the core winding portion in unrotative state by merely rotating the wound core as described above, operating efficiency for fixing the wound core to the core winding portion can be raised.

What is claimed is:

1. A transformer comprising:

a coil comprising:

a pair of core winding portions; and a pair of coupling portions for coupling the core winding portions so as to space the core winding portions a predetermined distance from each other, said coil bobbin being formed, on its whole outer periphery, with a groove;

wherein a cross-sectional shape of said groove comprises:

an open hexagon; and a pair of opposed parallel straight side portions which extend from said open hexagon;

a winding which is obtained by winding a conductor directly around the groove of the coil bobbin a predetermined number of times by alignment winding; and a pair of wound cores each of which is obtained by winding an electromagnetic steel plate directly around each of the core winding portions of the coil bobbin a predetermined number of times;

wherein an outer peripheral surface of each of opposite side walls of the groove at the core winding portions has an arcuate cross-sectional shape; and wherein the opposed parallel straight side portions of the groove intersect with each arcuate outer peripheral surface of the opposite side walls of the groove at the core winding portions such that the coil bobbin has a cross-sectional shape similar to a shape of distal ends of a pair of scissors.

2. A transformer as claimed in claim 1, wherein the outer peripheral surface of each of the side walls of the groove at the core winding portions has a radius of curvature equal to an inside diameter of the wound cores.

3. A transformer as claimed in claim 1, wherein an outer peripheral surface of a bottom wall of the groove at the core winding portions is formed flat.

4. A transformer as claimed in claim 1, wherein the groove is formed into a cross-sectional shape having a width of a mouth of the groove not less than a width of a bottom wall of the groove such that the conductor constituting the winding is piled on one another in an alignment winding method.

5. A transformer as claimed in claim 4, wherein said open hexagonal cross-sectional shape of a channel steel is such that the bottom wall of the groove is connected with each of the side walls of the groove at an angle of about 120°.

6. A transformer as claimed in claim 1, wherein the coil bobbin comprises an outer frame and an inner frame and the winding comprises first and second windings;

the outer frame including a pair of first core winding portions and a pair of first coupling portions for coupling the first core winding portions so as to space the first core winding portions a first predetermined distance from each other and being formed, on its whole outer periphery, with a first groove for receiving the first winding;

the inner frame including a pair of second core winding portions and a pair of second coupling portions for coupling the second core winding portions so as to space the second core winding portions a second predetermined distance from each other and being formed, on its whole outer periphery, with a second groove for receiving the second winding;

wherein the inner frame is integrally assembled with the outer frame such that the second groove is disposed inside the first groove.

7. A transformer as claimed in claim 1, wherein the coil bobbin is formed into a rectangular shape such that each of the core winding portions and the coupling portions extends rectilinearly.

8. A coil bobbin which is formed by alignment winding, on its whole outer periphery, with a groove for receiving a winding, and comprises:

a pair of core winding portions around each of which is adapted to be directly wound an electromagnetic steel plate, wound a predetermined number of times, so as to form a wound core; and a pair of coupling portions for coupling the core winding portions so as to space the core winding portions a predetermined distance from each other;

wherein an outer peripheral surface of opposite side walls of the groove at the core winding portions is curved so as to have an arcuate cross-sectional shape; and wherein a cross-sectional shape of said groove comprises: an open hexagon; and a pair of opposed parallel straight side portions which extend from said open hexagon; and wherein the opposed parallel straight side portions of the groove intersect with each arcuate outer peripheral surface of the opposite side walls of the groove at the core winding portions such that the coil bobbin has a cross-sectional shape similar to a shape of distal ends of a pair of scissors.

9. A coil bobbin as claimed in claim 8, wherein the outer peripheral surface of each of the side walls of the groove at the core winding portions has a radius of curvature equal to an inside diameter of the wound core.

10. A coil bobbin as claimed in claim 8, wherein an outer peripheral surface of a bottom wall of the groove at the core winding portions is formed flat.

11. A coil bobbin as claimed in claim 8, wherein the groove is formed into a cross-sectional shape having a width of a mouth of the groove not less than a width of a bottom wall of the groove such that a conductor constituting the winding is piled on one another in an alignment winding method.

12. A coil bobbin as claimed in claim 11, wherein said open hexagonal cross-sectional shape of a channel steel is such that the bottom wall of the groove is connected with each of the side walls of the groove at an angle of about 120°.

13. A coil bobbin as claimed in claim 8, which comprises an outer frame and an inner frame;

a winding comprising first and second windings;

the outer frame including a pair of first core winding portions and a pair of first coupling portions for coupling the first core winding portions so as to space the first core winding portions a first predetermined distance from each other and being formed, on its whole outer periphery, with a first groove for receiving the first winding;

the inner frame including a pair of second core winding portions and a pair of second coupling portions for coupling the second core winding portions so as to space the second core winding portions a second predetermined distance from each other and being formed, on its whole outer periphery, with a second groove for receiving the second winding;

wherein the inner frame is integrally assembled with the outer frame such that the second groove is disposed inside the first groove.

14. A coil bobbin as claimed in claim 8, which is formed into a rectangular shape such that each of the core winding portions and the coupling portions extends rectilinearly.

* * * * *